US009872108B2

(12) United States Patent
Yoon et al.

(10) Patent No.: US 9,872,108 B2
(45) Date of Patent: Jan. 16, 2018

(54) LOUDSPEAKER DEVICE AND AUDIO OUTPUT APPARATUS HAVING THE SAME

(71) Applicant: SAMSUNG ELECTRONICS CO., LTD., Suwon-si, Gyeonggi-do (KR)

(72) Inventors: Ho-jin Yoon, Yongin-si (KR); Min Kim, Suwon-si (KR); Liam Joseph Kelly, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/171,308

(22) Filed: Jun. 2, 2016

(65) Prior Publication Data

US 2016/0373862 A1 Dec. 22, 2016

(30) Foreign Application Priority Data

Jun. 17, 2015 (KR) ..... 10-2015-0085770

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 7/12*** | (2006.01) |
| *H04R 7/16* | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 7/16* (2013.01)

(58) Field of Classification Search

CPC ... H04R 3/04; H04R 7/12; H04R 7/18; H04R 9/06; H04R 9/025; H04R 7/16

USPC ..... 381/396, 399, 420, 401–402

See application file for complete search history.

(56) References Cited

U.S. PATENT DOCUMENTS

| | | | | |
|---|---|---|---|---|
| 4,484,037 | A | 11/1984 | Nieuwendijk et al. | |
| 2006/0023912 | A1* | 2/2006 | Mazarakis | H04R 7/06 381/396 |
| 2007/0165902 | A1* | 7/2007 | Matsumura | H04R 9/025 381/396 |
| 2011/0200223 | A1* | 8/2011 | Hiwatashi | H04R 9/02 381/400 |

(Continued)

FOREIGN PATENT DOCUMENTS

| | | |
|---|---|---|
| CN | 103997710 | 8/2014 |
| WO | WO 2015/184953 | 12/2015 |

*Primary Examiner* — Disler Paul

(74) *Attorney, Agent, or Firm* — Staas & Halsey LLP

(57) ABSTRACT

A loudspeaker device includes a frame having a bottom portion with a curved surface along a first direction and a pair of lateral portions provided at lateral sides of the bottom portion in the first direction; a plurality of magnets curved and extended along the curved surface of the bottom portion, and arranged to be spaced apart from each other; a diaphragm supported by the pair of lateral portions, curved in parallel with the curved surface of the bottom portion, and spaced apart at a predetermined distance from top surfaces of the plurality of magnets; and a coil provided on the diaphragm at positions corresponding to spaces between the plurality of magnets in the first direction, the coil being configured to drive the diaphragm to vibrate in a direction perpendicular to the curved surface of the bottom portion of the frame by a magnetic field formed by the plurality of magnets as an audio signal is electrically applied.

10 Claims, 22 Drawing Sheets

(56) References Cited

U.S. PATENT DOCUMENTS

| | | | | |
|---|---|---|---|---|
| 2011/0255734 | A1* | 10/2011 | Marugami | H04R 9/025 381/398 |
| 2016/0057541 | A1* | 2/2016 | Porter | H04R 9/025 381/412 |
| 2016/0212546 | A1* | 7/2016 | Salvatti | H04R 9/06 |

* cited by examiner

LOUDSPEAKER DEVICE AND AUDIO OUTPUT APPARATUS HAVING THE SAME

CROSS-REFERENCE TO RELATED APPLICATIONS

This application claims priority from Korean Patent Application No. 10-2015-0085770 filed on Jun. 17, 2015 in the Korean Intellectual Property Office, the disclosure of which is incorporated herein by reference

BACKGROUND

1. Field

Apparatuses and methods consistent with the exemplary embodiments relate to a loudspeaker device outputting a sound based on an audio signal and an audio output apparatus having the same, and more particularly to a loudspeaker device and an audio output apparatus having the same, in which an audible region where a user can hear sound normally is not reduced even when the loudspeaker device has a slim structure by taking an occupying space into account.

2. Description of the Related Art

A loudspeaker device or loudspeaker unit is an electricity to sound conversion device that is included as a sub structure in an audio output apparatus or a separate device locally connected to the audio output apparatus. The loudspeaker device outputs a sound of a frequency band audible to a human, i.e., a frequency band of 20 Hz to 20 KHz, based on an audio signal processed by the audio output apparatus.

Basically, humans have an eardrum that is a thin membrane in their ear. When the eardrum vibrates, the brain regards the vibration of the eardrum as a sound so that a human can hear the sound. The vibration of the eardrum is caused by rapid variation in pressure of air. When an object makes a sound, the object vibrates in air and thus air particles are also vibrated. The vibration of the air particles is propagated along ambient air particles. That is, the vibration is carried via air. In such a manner, the sound output from the loudspeaker device travels to a human's ear through air.

The audio output apparatus with the loudspeaker device is achieved by various kinds of electronic apparatuses capable of processing an audio signal. The audio output apparatus may receive a processed audio signal from the outside and output it as a sound through the loudspeaker device, or may process an audio signal by itself. The latter is called an audio processing apparatus, and the audio processing apparatus may be achieved to simply output only a sound, but is mostly achieved by a video processing apparatus or display apparatus capable of reproducing an image and a sound.

A video processing apparatus processes a video signal or video data received from the exterior in accordance with various video processing processes. The video processing apparatus may display an image based on the processed video data on its own display panel, or output the processed video signal to another display apparatus provided with a panel so that on the display apparatus can display an image based on the processed video signal. That is, the video processing apparatus includes the panel capable of displaying an image or includes no panel as long as it can process the video data. For example, the former may include a television (TV), and the latter may include a set-top box.

When the loudspeaker device is applied to such an apparatus, the outer appearance and inner structure of the apparatus are determined in accordance with various factors such as a space allowable to be occupied with the loudspeaker device, harmony with the loudspeaker device placed inside the apparatus, etc. However, in a certain case of the apparatus with the loudspeaker device, a user cannot correctly listen to a sound output from the loudspeaker device in accordance with their position. In this case, a new structure or method is needed to be applied to the loudspeaker so that a user can more correctly listen to the sound.

SUMMARY

According to an aspect of the present disclosure a loudspeaker device includes a frame including a bottom portion having a curved surface along a first direction and a pair of lateral portions provided at lateral sides of the bottom portion in the first direction; a plurality of magnets curved and extended along the curved surface of the bottom portion, and arranged to be spaced apart from each other; a diaphragm supported by the pair of lateral portions, curved in parallel with the curved surface of the bottom portion, and spaced apart at a predetermined distance from top surfaces of the plurality of magnets; and a coil provided on the diaphragm at positions corresponding to spaces between the plurality of magnets in the first direction, and the coil being configured to drive the diaphragm to vibrate in a direction perpendicular to the curved surface of the bottom portion of the frame by a magnetic field formed by the plurality of magnets as an audio signal is electrically applied. Thus, it is possible to provide the loudspeaker device having a slim structure, the sound output region of which is determined in accordance with cases of using the loudspeaker device to diffuse or focus a sound.

The magnet, the coil and the diaphragm may be bent outward in a second direction of outputting a sound perpendicularly to the first direction. Thus, it is possible to enlarge an audible region of a user who can listen to a sound based on the vibration of the diaphragm.

The curved surface may have different curvatures between at least two sections along the first direction.

The plurality of magnets may be arranged to make their upper sides alternate in polarities along the first direction, and the coils may be arranged in between the plurality of magnets. Thus, the diaphragm bent to have a certain curvature can uniformly vibrate.

The coil and the diaphragm may be provided on an outer circumferential side of the magnet having a circular closed-loop, and the diaphragm may be configured to vibrate in a radial direction of the magnet to make a sound. Thus, the loudspeaker device can radially output a sound in all directions over 360 degrees.

The magnet, the coil and the diaphragm may be bent inward in a direction opposite to a second direction of outputting a sound perpendicularly to the first direction. Thus, the audible region of the sound output from the loudspeaker device is limited to a narrow area, so that a user out of the corresponding area cannot hear the sound normally.

Further, the curved surface can have a uniform curvature along the first direction. Alternatively, the curved surface may have different curvatures between at least two sections along the first direction.

The bottom portion may include conductive metal, and may be configured to support lower surfaces of the plurality of magnets.

According to another aspect of the present disclosure, an audio output apparatus includes one or more loudspeaker devices; and an audio processor configured to process an audio signal to make a sound from the loudspeaker device. The loudspeaker device includes a frame including a bottom portion having a curved surface along a first direction and a pair of lateral portions provided at lateral sides of the bottom portion in the first direction; a plurality of magnets curved and extended along the curved surface of the bottom portion and arranged to be spaced apart from each other; a diaphragm supported by the pair of lateral portions, curved in parallel with the curved surface of the bottom portion, and spaced apart at a predetermined distance from top surfaces of the plurality of magnets; and a coil provided on the diaphragm at positions corresponding to spaces between the plurality of magnets in the first direction, the coil being configured drive the diaphragm to vibrate in a direction perpendicular to the curved surface of the bottom portion of the frame by a magnetic field formed by the plurality of magnets as the audio signal processed by the audio processor is electrically applied. Thus, it is possible to provide the loudspeaker device having a slim structure, the sound output region of which is determined in accordance with cases of using the loudspeaker device to diffuse or focus a sound.

The magnet, the coil and the diaphragm may be bent outward in a second direction of outputting a sound perpendicularly to the first direction. Thus, it is possible to enlarge an audible region of a user who can listen to a sound based on the vibration of the diaphragm.

The curved surface may have different curvatures between at least two sections along the first direction.

The plurality of magnets may be arranged to make their upper sides alternate in polarities along the first direction, and the coils may be arranged in between the plurality of magnets. Thus, the diaphragm bent to have a certain curvature can uniformly vibrate.

The coil and the diaphragm may be provided on an outer circumferential side of the magnet having a circular closed-loop, and the diaphragm may be configured to vibrate in a radial direction of the magnet to make a sound. Thus, the loudspeaker device can radially output a sound in all directions over 360 degrees.

The magnet, the coil and the diaphragm may be bent inward in a direction opposite to a second direction of outputting a sound perpendicularly to the first direction. Thus, the audible region of the sound output from the loudspeaker device is limited to a narrow area, so that a user out of the corresponding area cannot hear the sound normally.

Further, the curved surface can have a uniform curvature along the first direction. Alternatively, the curved surface may have different curvatures between at least two sections along the first direction.

The bottom portion may include conductive metal, and supports lower surfaces of the plurality of magnets.

Additional aspects and/or advantages will be set forth in part in the description which follows and, in part, will be apparent from the description, or may be learned by practice of the invention.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION

Below, exemplary embodiments will be described in detail with reference to accompanying drawings. The following descriptions of the exemplary embodiments are made by referring to elements shown in the accompanying drawings, in which like numerals refer to like elements having substantively the same functions.

In the description of the exemplary embodiments, an ordinal number used in terms such as a first element, a second element, etc. is employed for describing variety of elements, and the terms are used for distinguishing between one element and another element. Therefore, the meanings of the elements are not limited by the terms, and the terms are also used just for explaining the corresponding embodiment without limiting the idea of the invention.

Further, the exemplary embodiments will describe only elements directly related to the idea of the invention, and description of the other elements will be omitted. However, it will be appreciated that the elements, the descriptions of which are omitted, are not unnecessary to realize the apparatus or system according to the exemplary embodiments. In the following descriptions, terms such as "include" or "have" refer to presence of features, numbers, steps, operations, elements or combination thereof, and do not exclude presence or addition of one or more other features, numbers, steps, operations, elements or combination thereof.

Figure 1:
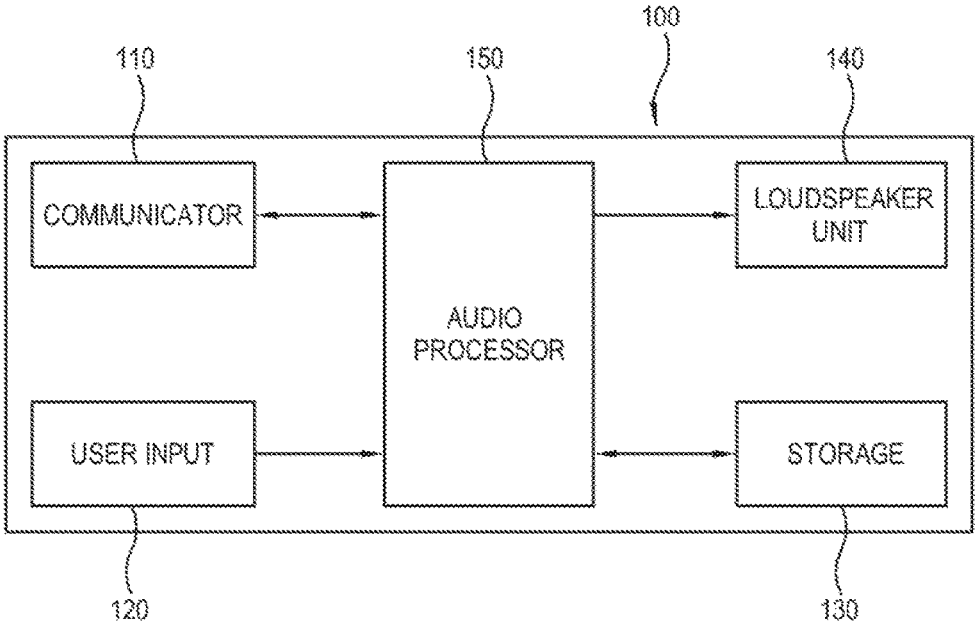
FIG. 1 is a block diagram of an audio output apparatus according to a first exemplary embodiment.

FIG. 1 is a block diagram of an audio output apparatus 100 according to a first exemplary embodiment.

As shown in FIG. 1, the audio output apparatus 100 according to the first exemplary embodiment is achieved by an audio processing apparatus that can process and output an audio signal in accordance with audio processing processes. However, the audio output apparatus 100 may be achieved by a general loudspeaker that outputs a sound based on an audio signal processed by an external apparatus (not shown) connected to the audio output apparatus 100 without processing an audio signal by itself. Further, this exemplary describes basic elements related to only audio output in the audio output apparatus 100, but the audio output apparatus 100 may further include elements for additional functions in accordance with materialization as well as the elements related to the audio output.

The audio output apparatus 100 includes a communicator 110 for communicating with an external apparatus, a user input 120 for receiving a user's input, a storage 130 for storing data, a loudspeaker unit or loudspeaker device 140 for outputting a sound, and an audio processor 150 for processing an audio signal to be output as a sound through the loudspeaker device 140.

The communicator 110 includes hardware communication circuitry or hardware communication interface which receives an audio signal from various audio sources. The communicator 110 is not limited to receiving an audio signal from the external apparatus, but may transmit a signal to the external apparatus, thereby achieving interactive communication. The communicator 110 is achieved by communication ports respectively corresponding to various communication standards and an assembly of communication modules. Here, there are no limits to one kind or type of supportable protocol and connection target. For example, the communicator 110 may include a radio frequency integrated circuit (RFIC, not shown) for receiving an RF signal, a wireless fidelity (Wi-Fi) communication module (not shown) for wireless network communication, an Ethernet module (not shown) for wired network communication, a universal serial bus (USB) port (not shown) for local connection with a USB memory, etc.

The user input 120 sends various preset control command or information to the audio processor 150 in response to a user's control or input. The user input 120 sends the audio processor 150 various events generated by a user's control based on their intention. The user input 120 may be achieved in various forms in accordance with methods of inputting information. For example, the user input 120 may include a button provided outside the audio output apparatus 100, a touch pad, a touch screen, a remote controller separated from a main body of the audio output apparatus 100, other input device capable of communicating with the audio output apparatus 100, etc.

The storage 130 stores various data under process and control of the audio processor 150. The storage 130 is accessed by the audio processor 150 to apply reading, writing, editing, deleting, updating, etc. to data. The storage 130 is achieved by a flash memory, a hard disc drive or the like nonvolatile memory so as to preserve data regardless of system power supplied to the audio output apparatus 100.

The loudspeaker device 140 converts an audio signal output from the audio processor 150 into a sound and outputs the sound. The loudspeaker device 140 vibrates air in accordance with an audio signal so as to propagate a sound. The loudspeaker device 140 may be a dynamic type using a magnet, an electrostatic type using no magnets, a ribbon type, an ion type, etc. In this embodiment, the loudspeaker device 140 belongs to the dynamic type. Details of the loudspeaker device 140 will be described later.

The audio processor 150 processes an audio signal received through the communicator 110 or stored in the storage 130 in accordance with audio processing processes, so that the audio signal can be output as a sound through the loudspeaker device 140. The audio processing processes performed by the audio processor 150 may be variously designed in accordance with functions supported by the audio output apparatus 100. As an example of the main processes, there is amplification. The audio processor 150 is composed of at least one of hardware chipsets, a CPU, a micro-processor or a SOC.

Below, elements of the audio processor 150 will be described in more detail.

Figure 2:
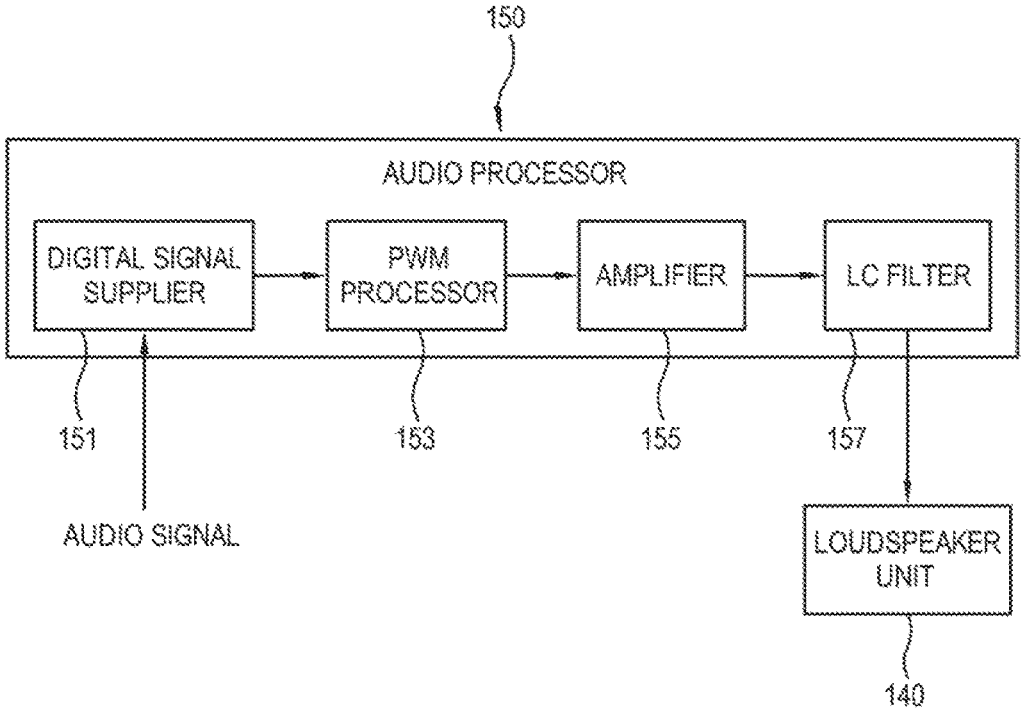
FIG. 2 is a block diagram of an audio processor in the audio output apparatus of FIG. 1.

FIG. 2 is a block diagram of an audio processor 150.

As shown in FIG. 2, the audio processor 150 includes a digital signal supplier 151 for outputting a digital audio signal; a pulse width modulation (PWM) processor 153 for outputting a PWM signal based on a digital signal output from the digital signal supplier 151, an amplifier 155 for amplifying the PWM signal output from the PWM processor 153, and an LC filter 157 for filtering the PWM signal amplified by the amplifier 155 by a predetermined frequency band to thereby demodulate the PWM signal.

The digital signal supplier 151 converts an audio signal into a digital signal of a pulse code. To this end, the digital signal supplier 151 includes a DSP, an MPEG converter IC, etc.

The PWM processor 153 converts a pulse code modulation signal output from the digital signal supplier 151 into a PWM signal of low power.

The amplifier 155 amplifies the PWM signal of the low power, output from the PWM processor 153, into a PWM signal of high power by a semiconductor switching device of a switching circuit, e.g. using a field effect transistor (FET). For example, the amplifier 155 receives a PWM signal of 3.3V and amplifies it into a PWM signal of 5 to 40V. Further, the amplifier 155 processes the amplified PWM signal to be subject to low-band pass filtering, thereby outputting the filtered signal to the loudspeaker device 140.

The LC filter 157 includes an inductor and a capacitor, and basically passes or blocks a signal of a certain frequency band. In accordance with methods of combining the inductor and the capacitor, the LC filter 157 is achieved by one of a low pass filter (LPF), a high pass filter (HPF), and a band pass filter (BPF).

The LC filter 157 in this embodiment is achieved by the LPF in such a manner that an inductor is connected in series to a load and a capacitor is connected in parallel to the inductor. Thus, a signal component in a low frequency band can naturally pass the LC filter 157. However, a signal component in a high frequency band hardly passes the LC filter 157 since high impedance of the inductor causes low impedance of the capacitor.

The loudspeaker device 140 is basically provided corresponding to an audio signal of one channel. Thus, the audio output apparatus may include a plurality of loudspeaker devices 140 corresponding to audio signals of a plurality of channels. In this case, the amplifier 155 and the LC filter 157 are also provided corresponding to each channel.

There are various kinds of loudspeaker devices 140 in accordance with frequency bands of a sound to be output. The loudspeaker devices 140 include a sub-woofer corresponding to a frequency band of 20 Hz to 99 Hz, a woofer corresponding to a frequency band of 100 Hz to 299 Hz, a mid-woofer corresponding to a frequency band of 300 Hz to 499 Hz, a mid-range speaker corresponding to a frequency band of 500 Hz to 2.9 KHz, a tweeter speaker corresponding to a frequency band of 3 KHz to 6.9 KHz, and a super-tweeter speaker corresponding to a frequency band of 7 KHz to 20 KHz, in which one or more among them are selected and applied to the audio output apparatus 100.

Figure 3:
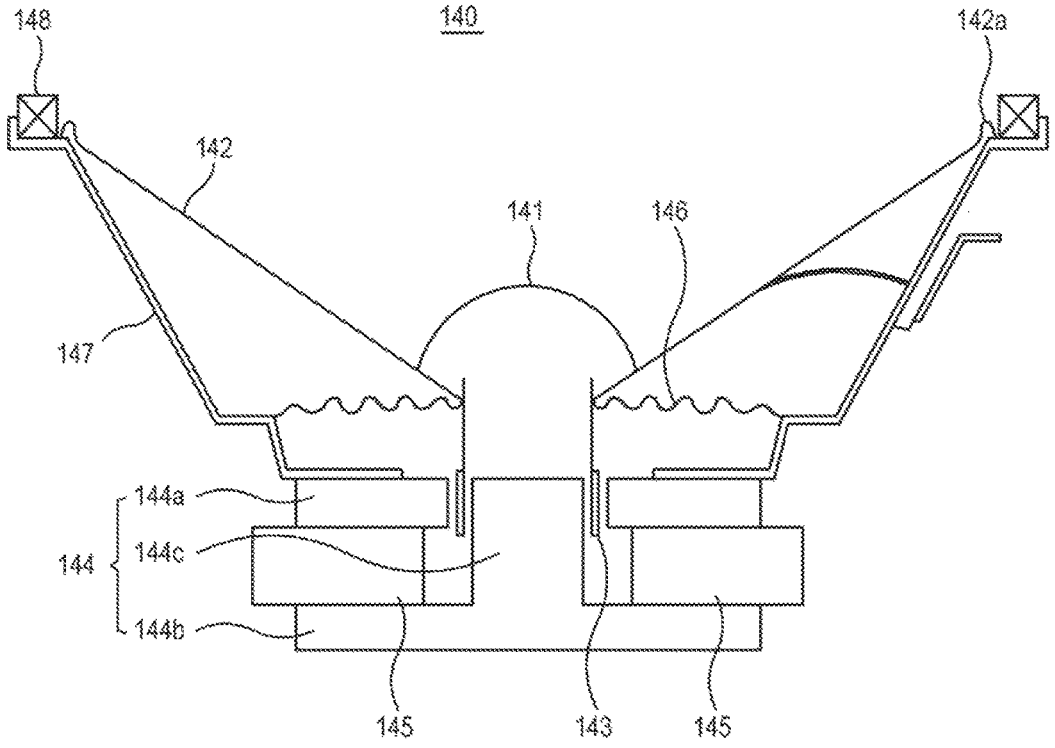
FIG. 3 is a lateral cross-section view showing a structure of a loudspeaker device in the audio output apparatus of FIG. 1.

FIG. 3 is a lateral cross-section view showing a structure of the loudspeaker device 140 according to the first exemplary embodiment.

As shown in FIG. 3, the loudspeaker device 140 according to the first exemplary embodiment has a cone-shaped cross section, i.e. a cone structure. Below, elements of the loudspeaker device 140 will be described. The loudspeaker device 140 is broadly divided into a vibration system and a magnetic circuit. The vibration system includes a diaphragm 142, a damper 146, a voice coil 143, etc., and the magnetic circuit includes a yoke 144, a magnet 145, etc.

A dust cap 141 basically protects the magnetic circuit of the loudspeaker device 140 from foreign materials. Further, the dust cap 141 may change a high frequency characteristic of the loudspeaker device 140 in accordance with its material, weight and cross-section shape.

The diaphragm 142 plays a key role in the loudspeaker device 140 as an element for generating vibration and reproducing a sound. If the diaphragm 142 has a cone shape like that of this exemplary embodiment, the diaphragm 142 is also called a cone paper. The diaphragm 142 makes a sound based on variation in air pressure corresponding to movement of the voice coil 143. The sound quality of the loudspeaker device 140 largely depends on the diaphragm 142. Therefore, the sound quality, sound color, etc. are varied depending on the material of the diaphragm 142, and the reproduction frequency characteristic is varied depending on the size, weight and cross-section shape of the diaphragm 142.

The diaphragm 142 may be made of various materials, for example, virgin pulp, polypropylene, polyvinyl chloride (PVC) fiber, carbon fiber, woven fabrics, composite materials, etc.

The outmost portion of the diaphragm 142 is coupled to an edge 142*a*. The edge 142*a* allows the diaphragm 142 to be smoothly vibrated and always returned to a center position. Further, the edge 142*a* serves to prevent soundwaves propagated forward from the diaphragm 142 and antiphase soundwaves propagated backward from being combined and offset each other.

The voice coil 143 receives electric signals output from the amplifier 155 (see FIG. 2) and the LC filter 157 (see FIG. 2), and generates substantive vibration based on repulsion to energy of the received electric signal. The voice coil 143 is manufactured by winding a conducting wire on a bobbin. The conducting wire may be made by coating a conductive body of copper, aluminum or the like with an insulating layer or adhesive layer, and the bobbin may be made of paper or an aluminum sheet.

The yoke 144 includes plates provided in the top and bottom of the magnet 145. The yoke 144 is used as a passage through which magnetic flux passes, and is made of iron to facilitate flow of the magnetic flux. The yoke 144 includes an upper plate 144*a* provided on the top of the magnet 145, a lower plate 144*b* provided on the bottom of the magnet 145, and a pole 144*c* protruding upward from the lower plate 144*b*.

Hereinafter, the 'upper' and 'lower' are defined as follows. Unless stated otherwise, an upper side of an element refers to a lateral direction in which a sound is output from the loudspeaker device 140, and a lower side of an element refers to a lateral direction opposite to the upper side. For example, the upper side of the magnet 145 refers to a lateral direction in which a sound is output from the loudspeaker device 140. However, these terms are just given for clarity of description, and do not limit the scope of the inventive concept.

The magnet 145 is a key element in the magnetic circuit of the loudspeaker device 140, and uses a permanent magnet. The magnet 145 induces the voice coil 143 to move up and down Fleming's left-hand rule. The magnet 145 provides strong and continuous magnetic flux in the magnetic circuit.

Fleming's rule is to describe a relationship between current and a magnetic field, and includes the right-hand rule and the left-hand rule. In Fleming's right-hand rule, when a right hand of a human is held with a thumb, a first finger and a second finger perpendicular to each other, the thumb represents a direction of moving a conductor in the magnetic field, the first finger represents a direction of the magnetic field, and the second finger represents a direction of the current. Fleming's right-hand rule is used for generators, and represents the direction of the current flowing when a conductor moves in the magnetic field.

On the other hand, Fleming's left-hand rule is to describe a direction of current forced when the current flows in a conducting wire within the magnetic field. When a left hand of a human is held with a thumb, a first finger and a second finger perpendicular to each other, the first finger represents a direction of the magnetic field, the second finger represents a direction of the current, and the thumb represents a direction of force on the conducting wire. Fleming's left-hand rule is used for motors.

The damper 146 supports a coupling portion between the diaphragm 142 and the voice coil 143 and keeps the center of the voice coil 143 so that the voice coil 143 can accurately move within a gap of the magnetic circuit.

A frame 147 determines the size and shape of the loudspeaker device 140, and supports the vibration system and magnetic circuit of the loudspeaker device 140. The frame 147 may be made of cold rolled steel sheet, acrylonitrile-butadiene-styrene resin (ABS) resin, aluminum, etc.

A gasket 148 prevents the edge 142*a* from being opened and separated by the vibration of the diaphragm 142 when the frame 147 and the diaphragm 142 are coupled.

The voice coil 143 is placed in a gap between the pole 144*c* and the upper plate 144*a*. If current flows in the voice coil 143 while magnetic flux caused by the magnet 145 passes this gap, Lorentz force is generated. The strength of Lorentz force is proportional to the magnitude of magnetic flux, the intensity of current, and the length of coil. Further, the direction of Lorentz force is perpendicular to the plane formed by magnetic flux density and current. In other words, the Lorentz force is generated in up and down directions in FIG. 3. For example, if the magnet 145 is arranged to have the N-pole thereof facing upward and the S-pole thereof facing downward, lines of magnetic force come out of the upper plate 144*a* and enter the S-pole of the magnet 145 via the pole 144*c* and the lower plate 144*b* in sequence, thereby forming a magnetic closed-loop. At this time, the magnetic field is concentrated in the gap, and electromagnetic force acts in the gap when current flows in the voice coil 143. Thus, the voice coil 143 and the diaphragm 142 move up and down.

Figure 4:
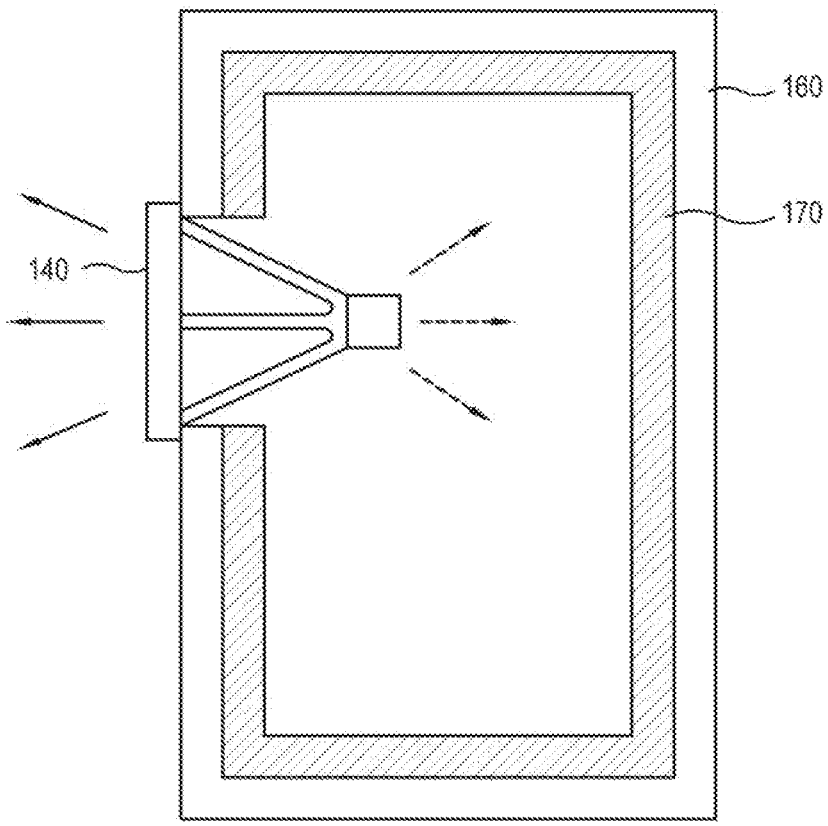
FIG. 4 is a lateral cross-section view showing that the loudspeaker device of FIG. 3 is mounted in an enclosure.

FIG. 4 is a lateral cross-section view showing that the loudspeaker device 140 is mounted in an enclosure 160.

As shown in FIG. 4, the loudspeaker device 140 is mounted in such a manner that the rear thereof is surrounded by the box-shaped enclosure 160 and the front thereof is exposed to the outside. If the loudspeaker device 140 is driven without the enclosure 160, loudness is lowered than that with the enclosure 160 or a sound is not normally output. The reason of this phenomenon is as follows.

The sound is heard by variation in air pressure. When the loudspeaker device 140 outputs a sound, air pressure increases in front of the loudspeaker device 140 but decreases in back of the loudspeaker device 140. If the loudspeaker device 140 is driven without the enclosure, a sound output forward from the loudspeaker device 140 offsets a sound output backward, thereby diminishing a sound. Therefore, a baffle is needed to prevent the sound output forward from offsetting against the sound output backward. If the baffle has a limited size, the sound output backward from the loudspeaker device 140 comes around the baffle and interferes with the sound output forward. In addition, a very big baffle is required for a low-pitched sound since the low-pitched sound has a longer wavelength than a high-pitched sound. However, the very big baffle is not practical, and therefore a box-shaped enclosure 160 is employed instead of the very big baffle.

The enclosure 160 may be provided with a sound-absorbing material 170 therein to absorb the sound output backward from the loudspeaker device 140, thereby preventing the sound from returning toward the loudspeaker device 140. The enclosure 160 may be closed as shown in FIG. 4, or may be opened with a duct. The enclosure 160 may be coupled to a casing (not shown) of the audio output apparatus 100, or may be formed as a single body with the casing (not shown) of the audio output apparatus 100.

The loudspeaker device 140 with this structure is generally used for outputting a sound of a low frequency band since its diaphragm has a relatively large vibrating amplitude. By the way, the diaphragm of the loudspeaker device 140 according to an exemplary embodiment has a con-shape of a relatively large width, thereby occupying much space. Therefore, the loudspeaker device 140 with this structure is difficult to be applied to a small or slim audio output apparatus 100.

Thus, a loudspeaker device according to a second exemplary embodiment, different in structure from the first exemplary embodiment, will be described below.

Figure 5:
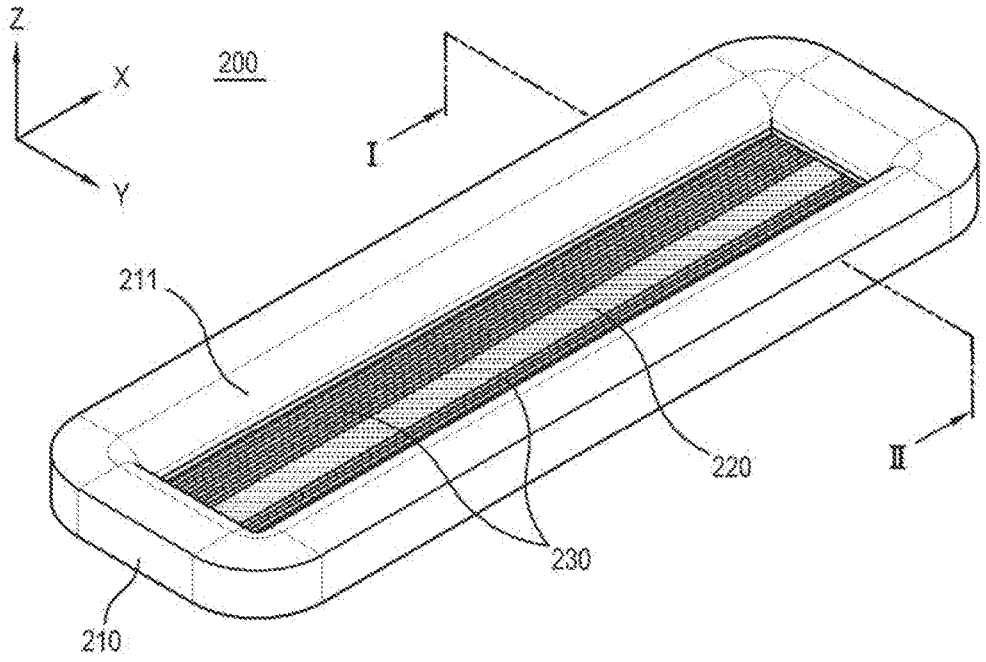
FIG. 5 is a perspective view of a loudspeaker device according to a second exemplary embodiment.

FIG. 5 is a perspective view of a loudspeaker device 200 according to the second exemplary embodiment. The loudspeaker device 200 according to the second exemplary embodiment is applicable to the audio output apparatus 100 by replacing the foregoing loudspeaker device according to the first exemplary embodiment.

As shown in FIG. 5, the loudspeaker device 200 according to the second exemplary embodiment includes a frame 210 shaped like a rectangular plate elongated in one direction, a diaphragm 220 arranged in a middle region of the frame 210, and a voice coil 230 embedded in the diaphragm 220. In terms of functions, the elements of the loudspeaker device 200 in this embodiment are similar to those of the first exemplary embodiment, and thus repetitive descriptions will be avoided as necessary.

In this exemplary embodiment, the longitudinal direction of the frame 210 will be called an X direction, the widthwise direction of the frame 210 will be called a Y direction, and the direction of outputting a sound from the loudspeaker device 200 will be called a Z direction. Further, the directions opposite to the X, Y and Z directions will be called −X, −Y, −Z directions, respectively.

The frame 210 is elongated along the X direction. The frame 210 has an opening 211 on the plane thereof toward the Z direction, so that the diaphragm 220 can be exposed through the opening 211 toward the Z direction. Further, a grille (not shown) may be additionally provided in the opening 211 and protect the diaphragm 220 from foreign materials without interfering with a sound output from the diaphragm 220.

The diaphragm 220 is provided in parallel to an X-Y plane, and supported on the frame 210 while blocking up the opening 211 from above the frame 210.

The voice coil 230 is attached to the surface of the diaphragm 220 in the form of foil or printed on the diaphragm 220. When an audio signal is applied to the voice coil 230, the voice coil 230 and the diaphragm 220 embedded with the voice coil 230 are vibrated along the Z direction. The voice coil 230 is extended on the diaphragm 220 in the X direction.

Figure 6:
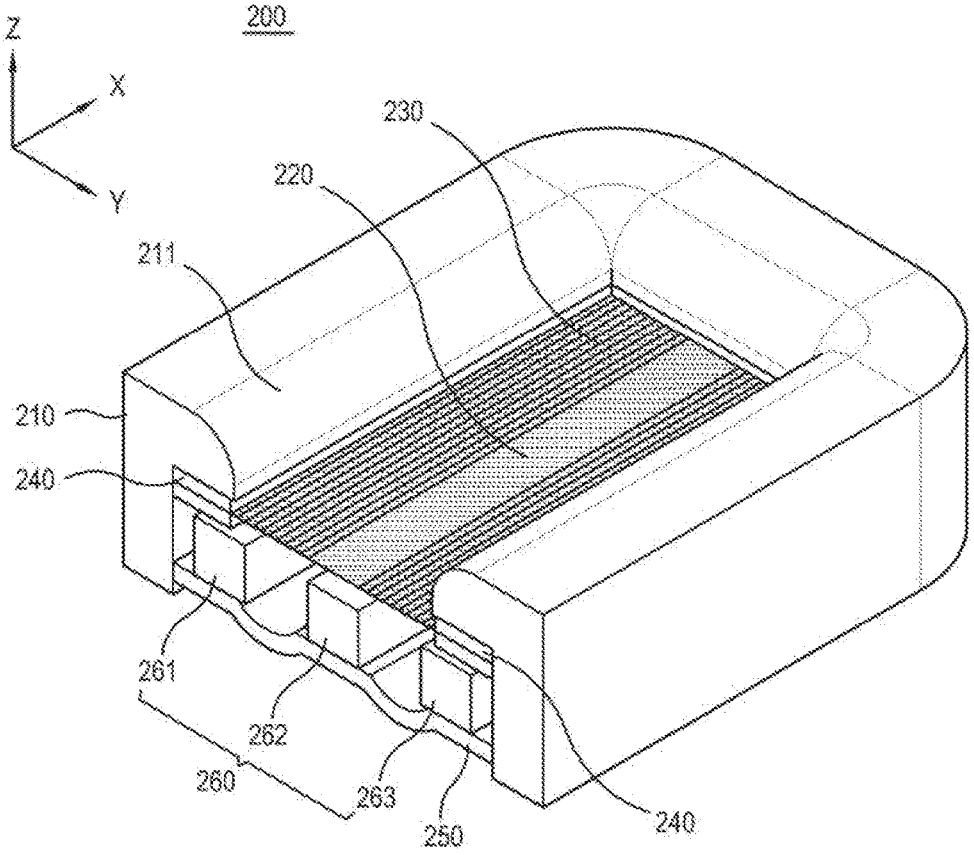
FIG. 6 is a cut-open perspective view showing the loudspeaker device of FIG. 5, taken along the line I-II.

FIG. 6 is a cut-open perspective view showing the loudspeaker device of FIG. 5, taken along the line I-II.

As shown in FIG. 6, the loudspeaker device 200 includes an edge 240 for supporting an edge of the diaphragm 220 from above the frame 210, a steel plate 250 provided at a lower side of the frame 210, and magnets 260 provided on the steel plate 250 and extended at a predetermined distance from the diaphragm 220 and the voice coil 230.

The edge 240 is provided around the opening 211 along an upper surface edge of the frame 210. The edge 240 supporting the four edges of the diaphragm 220 restores the diaphragm 220 to its original position and prevents the sound from offsetting each other when the diaphragm 220 vibrates by interaction between the voice coil 230 and the magnet 260.

The magnet 260 is put on a top surface of the steel plate 250, which faces the diaphragm 220. The steel plate 250 is used as a passage through which the magnetic flux of the magnet 260 passes. In this exemplary embodiment, the steel plate 250 includes a steel material, and is thus called the steel plate 250. The material for the plate 250 may include not only steel but also other conductive metals, such as copper, aluminum, alloys thereof, etc.

The magnet 260 is extended along the X direction in parallel with the extended direction of the voice coil 230. In accordance with the types of the voice coil 230, one or more magnets 260 may be provided and extended in parallel to each other in one direction. A predetermined gap is formed in between the top surface of the magnet 260 facing the diaphragm 220 and the diaphragm 220. This gap may be determined variously as long as the diaphragm 220 can vibrate and the voice coil 230 embedded in the diaphragm 220 is affected by the magnetic field of the magnet 260.

In this exemplary embodiment, the magnet 260 and the voice coil 230 are substantially straightly extended in parallel with each other along the X direction.

In this exemplary embodiment, there are three magnets 260 including a first magnet 261, a second magnet 262 and a third magnet 263, but not limited thereto. The number of magnets 260 does not limit the present inventive concept.

Among the magnets 260, the poles of the adjacent magnets, which face toward the diaphragm 220, are opposite to each other. That is, if the first magnet 261 is arranged to have the N-pole thereof facing toward the diaphragm 220 the S-pole thereof contacting the steel plate 250, the second magnet 262 adjacent to the first magnet 261 is arranged to have the S-pole thereof facing upward and the N-pole thereof facing downward. Likewise, the third magnet 263 adjacent to the second magnet 262 is arranged to have the N-pole thereof facing upward and the S-pole thereof facing downward. That is, if the first magnet 261, the second magnet 262 and the third magnet 263 are arranged in sequence along the Y direction, the upper poles of the respective magnets 260 alternate between the N-pole and the S-pole.

Further, the voice coil 230 is arranged to be interposed in between the magnets 260. That is, the voice coils 230 are respectively placed not directly above the first magnet 261, the second magnet 262 and the third magnet 263 but in between the first magnet 261 and the second magnet 262 and in between the second magnet 262 and the third magnet 263.

Figure 7:
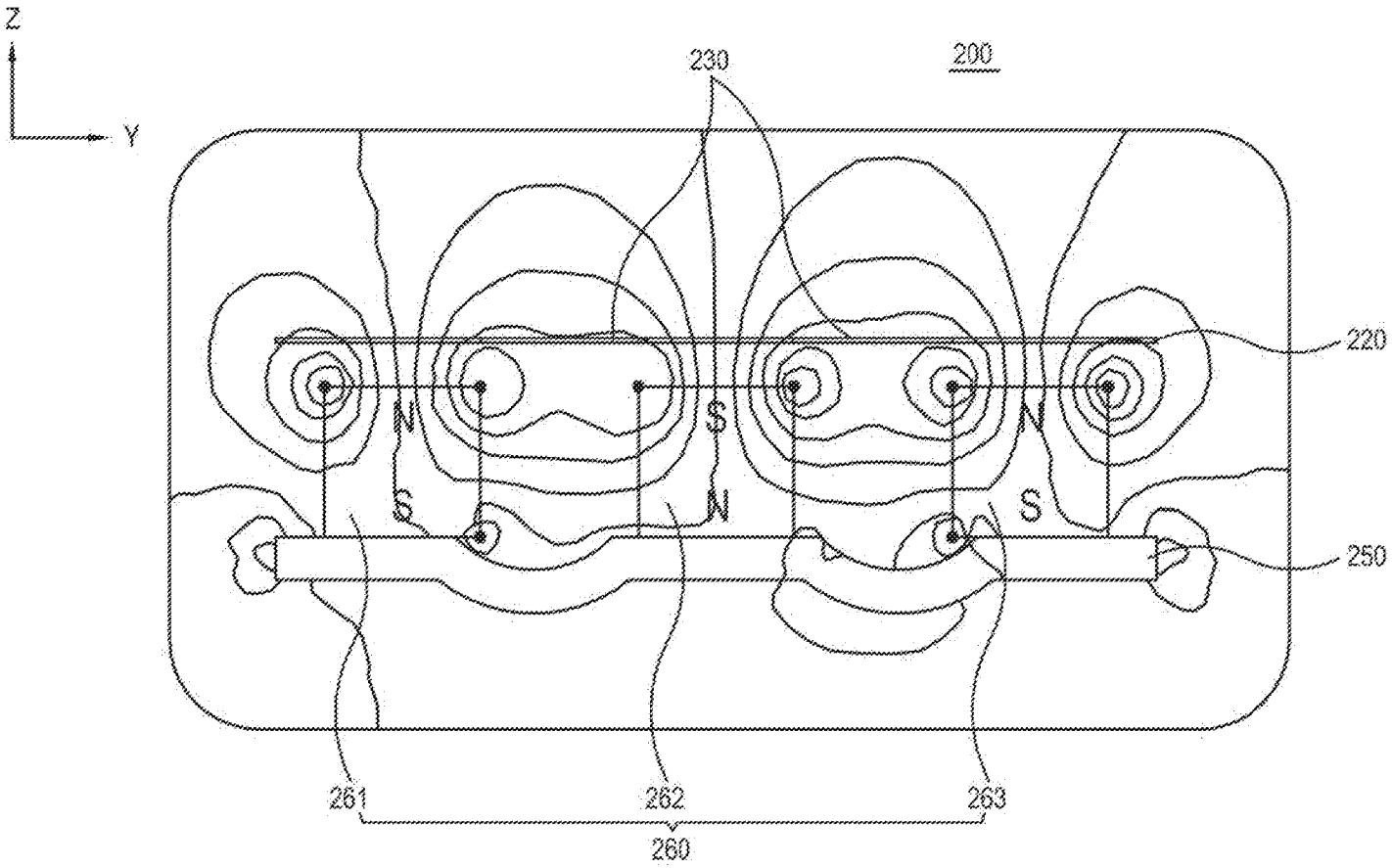
FIG. 7 is a view of showing an example of magnetic flux patterns formed by magnets in the loudspeaker device of FIG. 5.

FIG. 7 is a view of showing an example of magnetic flux patterns formed by the magnets 260 in the loudspeaker device 200.

As shown in FIG. 7, the magnetic flux comes out from the upper N-pole of the first magnet 261 and enters the lower S-pole of the second magnet 262, and the magnetic flux comes out from the lower N-pole of the second magnet 262 and enters the lower S-pole of the first magnet 261. Further, the magnetic flux comes out from the upper N-pole of the third magnet 263 and enters the upper S-pole of the second magnet 262, and the magnetic flux comes out from the lower N-pole of the second magnet 262 and enters the lower S-pole of the third magnet 263. Therefore, a front magnetic field is formed above the magnets 260.

Under such a condition, if voltage is applied to the voice coil 230, the diaphragm 220 vibrates up and down along the Z direction due to interaction between the applied voltage and the front magnetic field.

In this structure according to an exemplary embodiment, the diaphragm 220 and the voice coil 230 are flat and it is therefore possible to achieve a structure of the loudspeaker device 200 that is slimmer than that of the first exemplary embodiment. However, the vibrating amplitude of the diaphragm 220 in this exemplary embodiment is smaller than that of the first exemplary embodiment. Accordingly, the loudspeaker device 200 according to the second exemplary embodiment is difficult to be used for outputting a sound of a low frequency band and is thus generally used for outputting a sound of a high frequency band.

Additionally, a user may not normally hear a sound output from the loudspeaker device 200, which employs the diaphragm 220 flat along the Y direction, in accordance with their positions. This will be described later.

Figure 8:
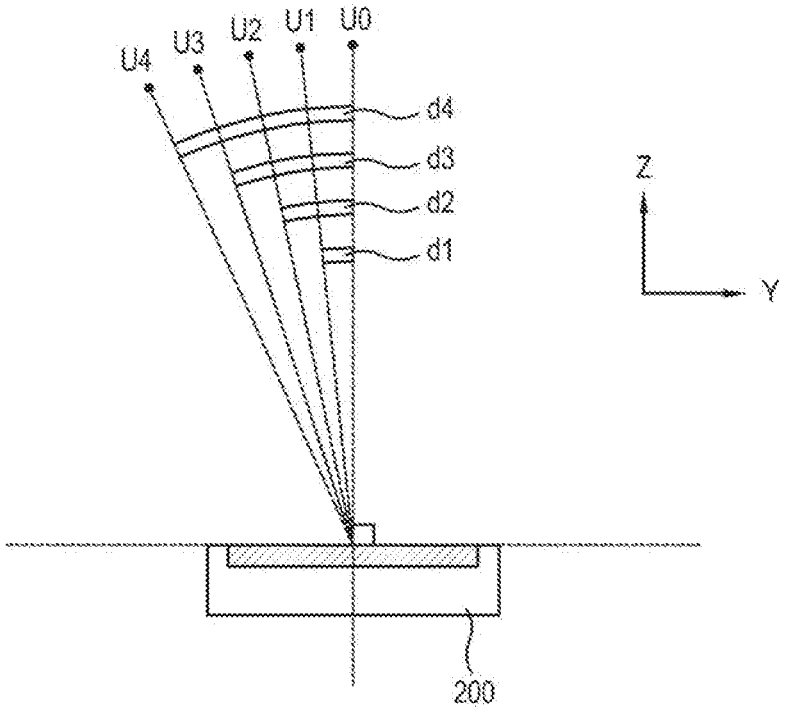
FIG. 8 is a view showing an example of a user's positions with respect to the loudspeaker device of FIG. 5.

FIG. 8 is a view showing an example of a user's positions with respect to the loudspeaker device 200.

Suppose that the loudspeaker device 200 is arranged in parallel with the Y direction and outputs a sound in the Z direction as shown in FIG. 8. In FIG. 8 a user's position on an axial line of the Z direction, i.e. on the Z axis passing through the center of the loudspeaker device 200 is 'U0'. Likewise, a user's positions on an axial line inclined at angle of 'd1', 'd2', 'd3' and 'd4' with respect to the Z axis is 'U1', 'U2', 'U3' and 'U4', respectively. For example, the angles of 'd1', 'd2', 'd3' and 'd4' are 10, 20, 30 and 40 degrees, respectively.

Since the diaphragm 220 (see FIG. 7) vibrates in the Z direction, a soundwave output from the loudspeaker device 200 propagates along the Z direction. In this case, if a user is positioned at 'U0', they straightly face the soundwave output from the loudspeaker device 200. On the other hand, if a user is positioned at one of 'U1' to 'U4', they obliquely face the soundwave output from the loudspeaker device 200. In particular, a user's position becomes more oblique as the angle increases from 'd1' to 'd4'.

Below, difference in sound according to a user's listening positions with respect to the loudspeaker device 200 will be described.

Figure 9:
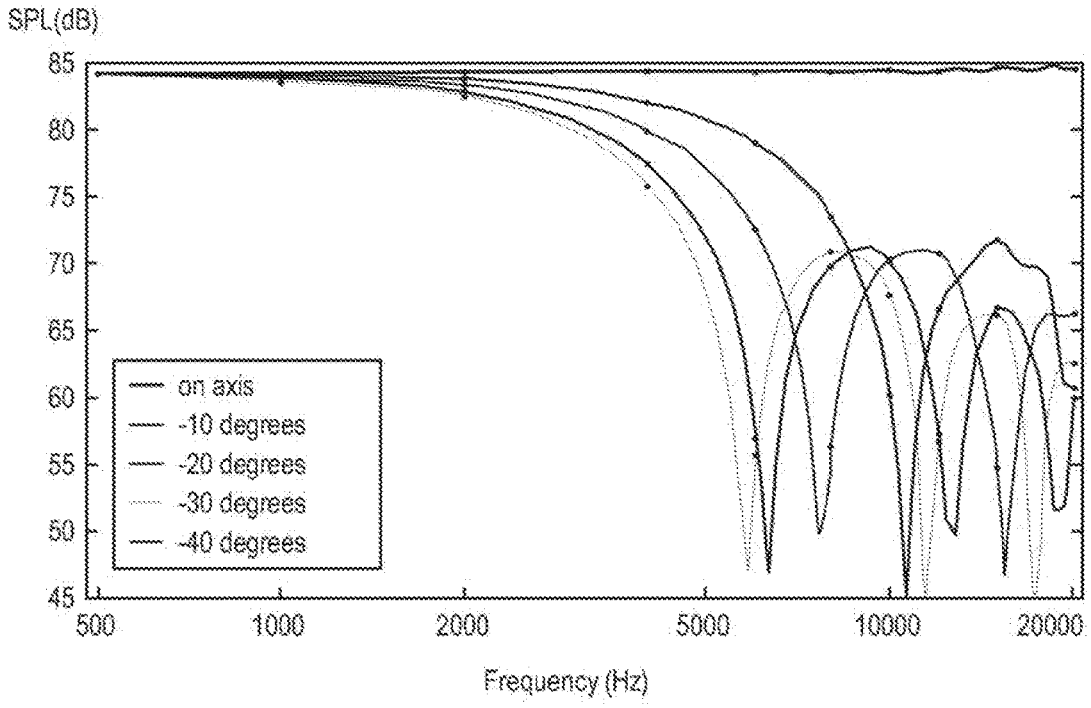
FIG. 9 is a graph showing variation in a sound pressure level against a frequency of a sound output from the loudspeaker device in accordance with a user's positions as shown in FIG. 8.

FIG. 9 is a graph showing variation in a sound pressure level against a frequency of a sound output from the loudspeaker device in accordance with a user's positions as shown in FIG. 8.

Referring to FIG. 9, the graph shows variation in a sound pressure level (SPL) against output sound in cases where a user is at a position on the axis and at positions inclined by 10, 20, 30 and 40 degrees from the axis. In the graph, the axis of abscissa indicates a frequency of output sound, and the axis of ordinate indicates a sound pressure level. For reference, a state of a user at the position on the axis will be called an 'on-axis' state and a state of users at the positions inclined by 10, 20, 30 and 40 degrees from the axis will be called an 'off-axis' state.

In the experiments for drawing this graph, the loudspeaker device had a length of 60 mm and a width of 10 mm, and a distance between the loudspeaker device and a user was 1 m.

When the frequency of the output sound was equal to or lower than 2,000 Hz, a sound pressure level of at least 80 dB was maintained at the foregoing five positions of a user, and there was little difference in the sound pressure level among the five user positions. That is, if the loudspeaker device outputs a sound of relatively low frequency band, a user can hear the sound normally regardless of his/her positions.

On the other hand, when the frequency of the output sound was higher than 3,000 Hz, the sound pressure level was maintained at 85 dB only in the 'on-axis' state, but noticeably lowered in the 'off-axis' state. When the frequency of the output sound exceeds 5,000 Hz, the sound pressure level in the 'off-axis' state was more seriously lowered. This means that a user cannot normally hear a sound of a high frequency band output from the loudspeaker device in the 'off-axis' state. That is, a user's position is important to normally hear a sound of a high frequency band output from the loudspeaker device. This problem refers to that an 'off-axis' characteristic in a horizontal orientation of the loudspeaker device is bad.

According to an exemplary embodiment, the loudspeaker device has a slim structure to occupy a small space, but this structure is susceptible to a user's positions when s/he listens to an output sound of a high frequency band.

To solve this problem, a third exemplary embodiment will be described below.

Figure 10:
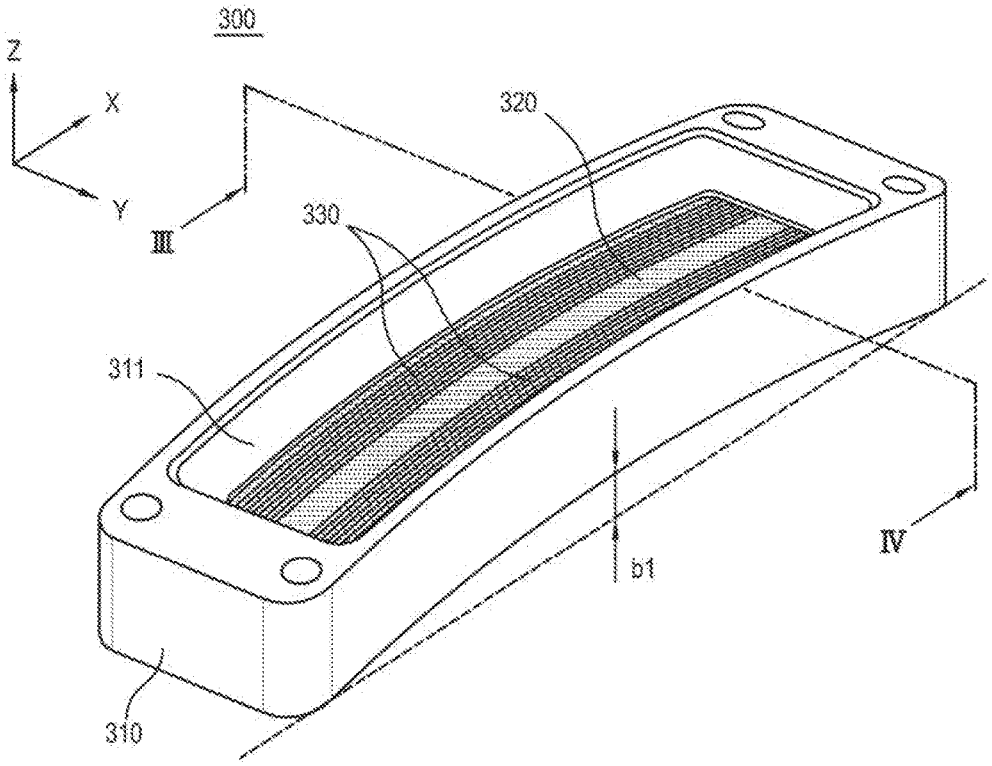
FIG. 10 is a perspective view of a loudspeaker device according to a third exemplary embodiment.

FIG. 10 is a perspective view of a loudspeaker device 300 according to a third exemplary embodiment. The loudspeaker device 300 according to the third exemplary embodiment is applicable to the audio output apparatus 100 by replacing the foregoing loudspeaker device according to the first exemplary embodiment.

As shown in FIG. 10, the loudspeaker device 300 according to the third exemplary embodiment includes a frame 310 bent to have a preset curvature and shaped like a rectangular plate extended in one direction, a diaphragm 320 arranged in a middle region of the frame 310, and a voice coil 330 embedded in the diaphragm 320. In terms of functions, the elements of the loudspeaker device 300 in this embodiment are similar to those of the foregoing exemplary embodiment, and thus repetitive descriptions will be avoided as necessary.

The frame 310 is lengthwise extended along the X direction. However, the frame 310 according to the third exemplary embodiment is bent to have a preset curvature on the contrary to that of the second exemplary embodiment substantively straightly extended in the X direction. That is, the center of the frame 310 is spaced apart at a distance of 'b1' from the bottom axial line of the X direction. The distance of 'b1' is determined by the bending curvature of the frame 310.

The bending curvature of the frame 310 is not limited to a specific numerical value since it is determined by taking various factors into account. If the curvature is so small that there is little difference in between the loudspeaker device 300 according to the third exemplary embodiment and that according to the second exemplary embodiment, the 'off-axis' characteristic of the horizontal orientation is not noticeably improved. On the other hand, if the curvature is so great that the loudspeaker device 300 can be noticeably improved in the 'off-axis' characteristic of the horizontal orientation, the loudspeaker device 300 has to become longer corresponding to the great curvature. Further, there is a limit to the curvature that the loudspeaker device 300 can have if manufacture of their inner elements is taken into account. Accordingly, the curvature is variously determined in consideration of such various factors, In this embodiment, the bending curvature for the loudspeaker device 300 is constant along the X direction, but not limited thereto. Alternatively, the bending curvature for the loudspeaker device 300 may be not constant along the X direction but vary depending on sections. For example, if the loudspeaker device 300 is installed being biased toward a left or right side of a display apparatus, an output range of a sound from the loudspeaker device 300 may be also biased to correspond to each of the left and right sides of the display apparatus. In this case, one section of the loudspeaker device 300 may have a greater bending curvature than the other section thereof along the X direction. That is, the bending curvature of the loudspeaker device 300 may be uniform or not uniform along the X direction.

The frame 310 has an opening 311 on the plane thereof toward the Z direction, so that the diaphragm 320 can be exposed through the opening 311 toward the Z direction. Further, a grille (not shown) may be additionally provided in the opening 311 and protect the diaphragm 320 from foreign materials without interfering with a sound output from the diaphragm 320.

The diaphragm 320 is not parallel to the X-Y plane, but bent to have a curvature corresponding to the bending curvature of the frame 310. Since the diaphragm according to the second exemplary embodiment is parallel to the X-Y plane, a wave surface of a sound propagated from the corresponding diaphragm in the Z direction is also regarded as it is parallel to the X-Y plane. On the other hand, a wave surface of a sound propagated from the diaphragm 320 according to the third exemplary embodiment in the Z direction is regarded as it is curved outward in the middle in the Z direction with respect to the X-Y plane. That is, with this structure, the diaphragm 320 makes a soundwave not only in one direction of the Z direction but radially with respect to the axial line of the Z direction.

The voice coil 330 is extended along the lengthwise direction of the diaphragm 320, and attached to the surface of the diaphragm 320 in the form of foil or printed on the diaphragm 320. That is, the voice coil 330 is also bent to have a curvature corresponding to the diaphragm 320 and the frame 310. When an audio signal is applied to the voice coil 330, the voice coil 330 and the diaphragm 320 embedded with the voice coil 330 are vibrated.

Thus, the loudspeaker device 300 according to this exemplary embodiment has a structure where the frame 310, the diaphragm 320 and the voice coil 330 are bent outward in the middle with respect to the direction of outputting the sound. The frame 310, diaphragm 320 and voice coil 330 are provided to have substantially the same curvature.

Figure 11:
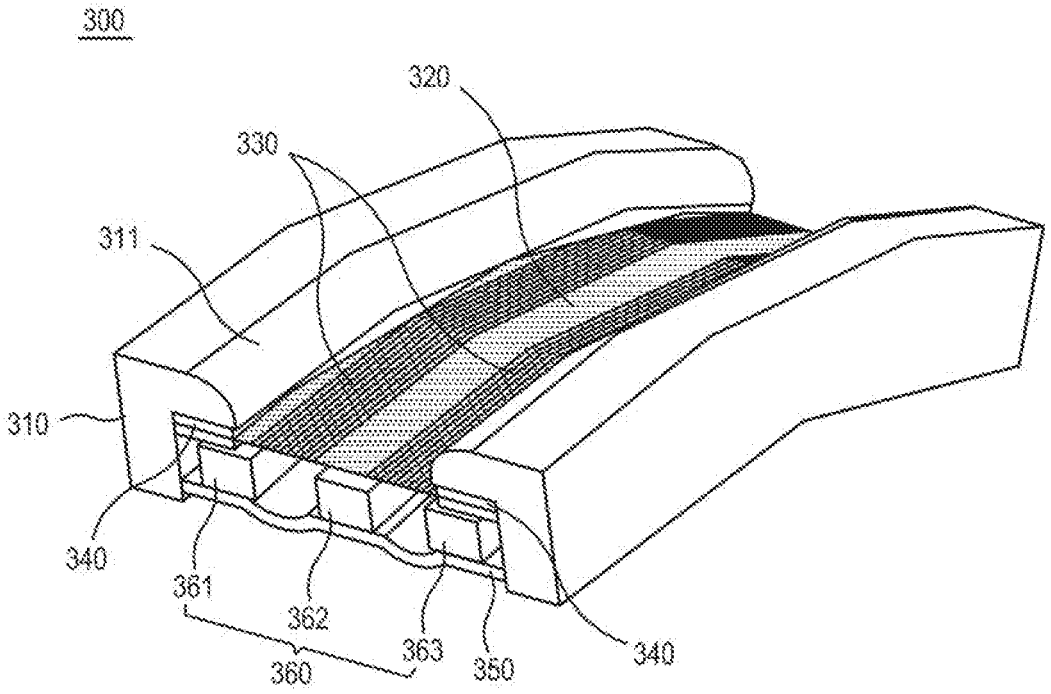
FIG. 11 is a cut-open perspective view of the loudspeaker device of FIG. 10, taken along the line III-IV.

FIG. 11 is a cut-open perspective view of the loudspeaker device of FIG. 10, taken along the line III-IV.

As shown in FIG. 11, the loudspeaker device 300 includes an edge 340 for supporting an edge of the diaphragm 320 from above the frame 310, a steel plate 350 provided at a lower side of the frame 310, and magnets 360 provided on the steel plate 350 and extended at a predetermined distance from the diaphragm 320 and the voice coil 330.

The edge 340 is provided around the opening 311 along an upper surface edge of the frame 310. The edge 340 supporting the four edges of the diaphragm 320 restores the diaphragm 320 to its original position and prevents the sound from offsetting each other when the diaphragm 320 vibrates by interaction between the voice coil 330 and the magnet 360.

Further, the edge 340 is bent corresponding to the frame 310 so that the diaphragm 320 bent to have a certain curvature can be supported on the frame 310 bent to have substantially the same curvature. However, the edges parallel to the Y direction are not bent among the four edges of the diaphragm 320, and thus the corresponding edges 340 are not bent.

The magnet 360 is put on a top surface of the steel plate 350, which faces the diaphragm 320. The steel plate 350 is used as a passage through which the magnetic flux of the magnet 360 passes.

Further, the steel plate 350 is used as a bottom portion of the frame 310, and bent so that the magnet 360 can be put on the steel plate 350. The left and right sides of the steel plate 350 support a pair of lateral portions of the frame 310.

The magnet 360 is bent to have the same curvature as the diaphragm 320 and the voice coil 330 with respect to the axial line of the X direction along the extended direction of the diaphragm 320 and the voice coil 330. Therefore, a uniform gap is maintained between the top surface of the magnet 360 facing the diaphragm 320 and the diaphragm 320. This gap may be determined variously as long as the diaphragm 320 can vibrate and the voice coil 330 embedded in the diaphragm 320 is affected by the magnetic field of the magnet 360.

In this exemplary embodiment, there are three magnets 360 including a first magnet 361, a second magnet 362 and a third magnet 363, but not limited thereto. The number of magnets 360 does not limit the present inventive concept.

Like the second exemplary embodiment, the poles of the adjacent magnets, which face toward the diaphragm 320, among the magnets 360 are opposite to each other. That is, if the first magnet 361 is arranged to have the N-pole thereof facing toward the diaphragm 320 the S-pole thereof contacting the steel plate 350, the second magnet 362 adjacent to the first magnet 361 is arranged to have the S-pole thereof facing upward and the N-pole thereof facing downward. Likewise, the third magnet 363 adjacent to the second magnet 362 is arranged to have the N-pole thereof facing upward and the S-pole thereof facing downward. That is, if the first magnet 361, the second magnet 362 and the third magnet 363 are arranged in sequence along the Y direction, the upper poles of the respective magnets 360 alternate between the N-pole and the S-pole.

Further, the voice coil 330 is arranged to be interposed in between the magnets 360. That is, the voice coils 330 are respectively placed not directly above the first magnet 361, the second magnet 362 and the third magnet 363 but in between the first magnet 361 and the second magnet 362 and in between the second magnet 362 and the third magnet 363. The principle that the diaphragm 320 vibrates due to the interaction between the magnet 360 and the voice coil 330 is the same as described above, and thus repetitive descriptions thereof will be avoided as necessary.

Briefly, the loudspeaker device 300 according to the third exemplary embodiment is bent outward in the middle in the direction of outputting a sound with respect to the axial line of the direction perpendicular to the direction of outputting the sound. In particular, the diaphragm 320, the voice coil 330 and the magnet 360 directly related to the sound output are bent to have the same curvature, so that a sound can be output not in one direction but radially in a plurality of directions.

Accordingly, the loudspeaker device 300 according to the third exemplary embodiment is more improved in the 'off-axis' characteristic of the horizontal orientation than that in the second exemplary embodiment. In other words, a user can hear a sound normally even though they are not in the 'on-axis' state.

Figure 12:
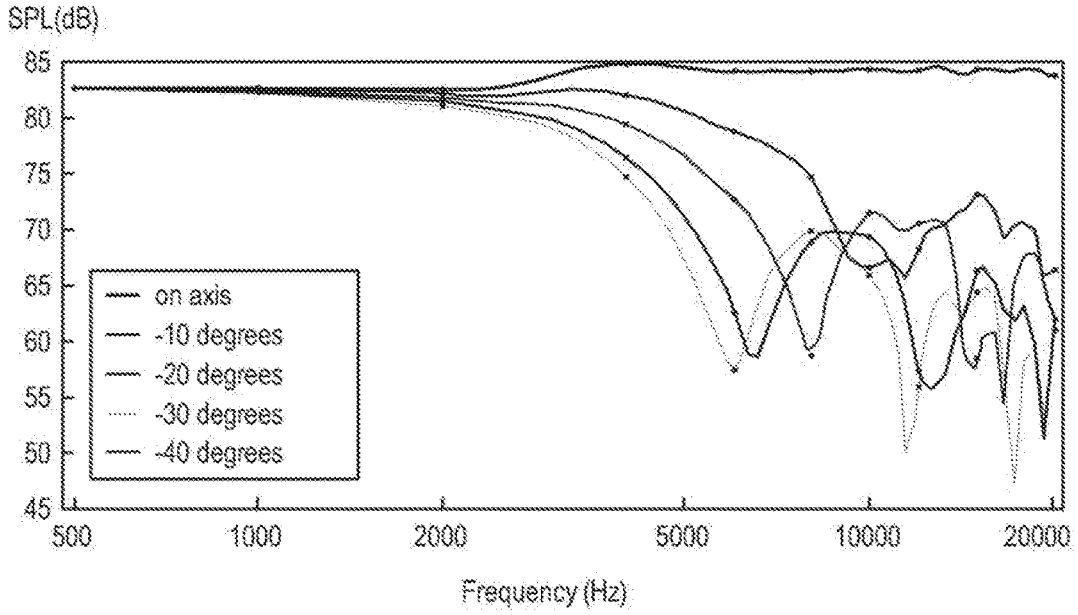
FIG. 12 is a graph showing variation in a sound pressure level against a frequency of a sound output from the loudspeaker device of FIG. 10.

FIG. 12 is a graph showing variation in a sound pressure level against a frequency of a sound output from the loudspeaker device according to the third exemplary embodiment.

Referring to FIG. 12, the graph shows variation in a sound pressure level (SPL) against output sound in cases where a user is in the 'on-axis' state and at positions inclined by 10, 20, 30 and 40 degrees from the 'on-axis' state. In this graph, the axis of abscissa indicates a frequency of output sound, and the axis of ordinate indicates a sound pressure level. Further, basic experimental conditions in FIG. 12 are the same as those of FIG. 9.

When the frequency of the output sound was equal to or lower than 2,000 Hz, a sound pressure level of at least 80 dB was maintained at the foregoing five positions of a user, and there was little difference in the sound pressure level among the five user positions. Like the second exemplary embodiment, if the loudspeaker device outputs a sound of relatively low frequency band, a user can hear the sound normally regardless of their position.

The sound pressure level was maintained even when the output sound has a frequency of 3,000 Hz to 4,000 Hz. In the second exemplary embodiment, the sound pressure level was noticeably lowered in the off-axis' state when the frequency of the output sound is higher than 3,000 Hz. In this regard, it will be appreciated that the third exemplary embodiment is improved in the 'off-axis' characteristic within the foregoing frequency range.

When the frequency of the output sound exceeds 5,000 Hz, the sound pressure level in the 'off-axis' state was more seriously lowered. Even in this condition, the sound pressure level was more improved than that of the second exemplary embodiment.

As compared with the second exemplary embodiment, the loudspeaker device according to the third exemplary embodiment is improved in the 'off-axis' characteristic of the horizontal orientation, and thus a user's audible region is expanded.

Below, processes of driving the loudspeaker device to output a sound will be described.

Figure 13:
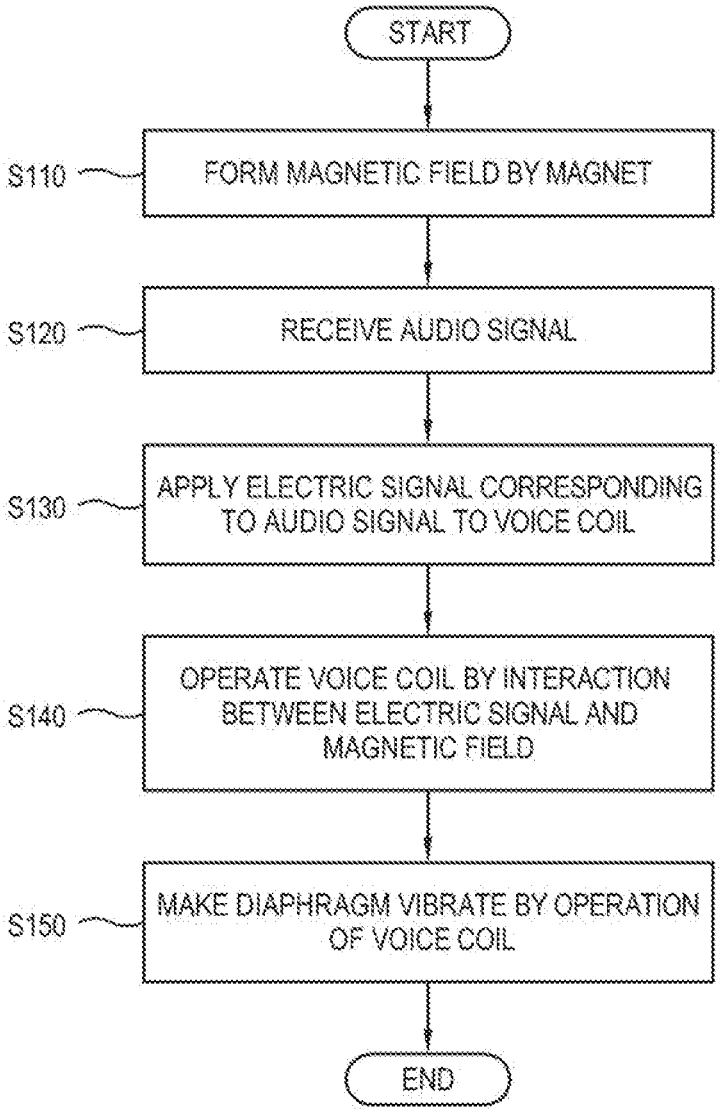
FIG. 13 is a flowchart of driving the loudspeaker device of FIG. 10 to output a sound.

FIG. 13 is a flowchart of driving the loudspeaker device to output a sound.

As shown in FIG. 13, at operation S110 the loudspeaker device has a magnetic field formed by the magnet. The voice coil embedded in the diaphragm is positioned within a zone to be affected by the magnetic field.

At operation S120 the loudspeaker device receives an audio signal.

At operation S130 the loudspeaker device applies an electric signal corresponding to the received audio signal to the voice coil.

At operation S140 the voice coil operates based on interaction between the electric signal and the magnetic field.

At operation S150 the operation of the voice coil causes the diaphragm to vibrate. Therefore, the loudspeaker device makes a sound.

In this exemplary embodiment, the loudspeaker device is bent outward in the middle toward the direction of outputting a sound, and thus improved in the 'off-axis' characteristic of the horizontal orientation, thereby increasing a user's audible region. However, a user's audible region may have to be reduced rather than increased in accordance with special cases of using the loudspeaker device.

This exemplary embodiment will be described below.

Figure 14:
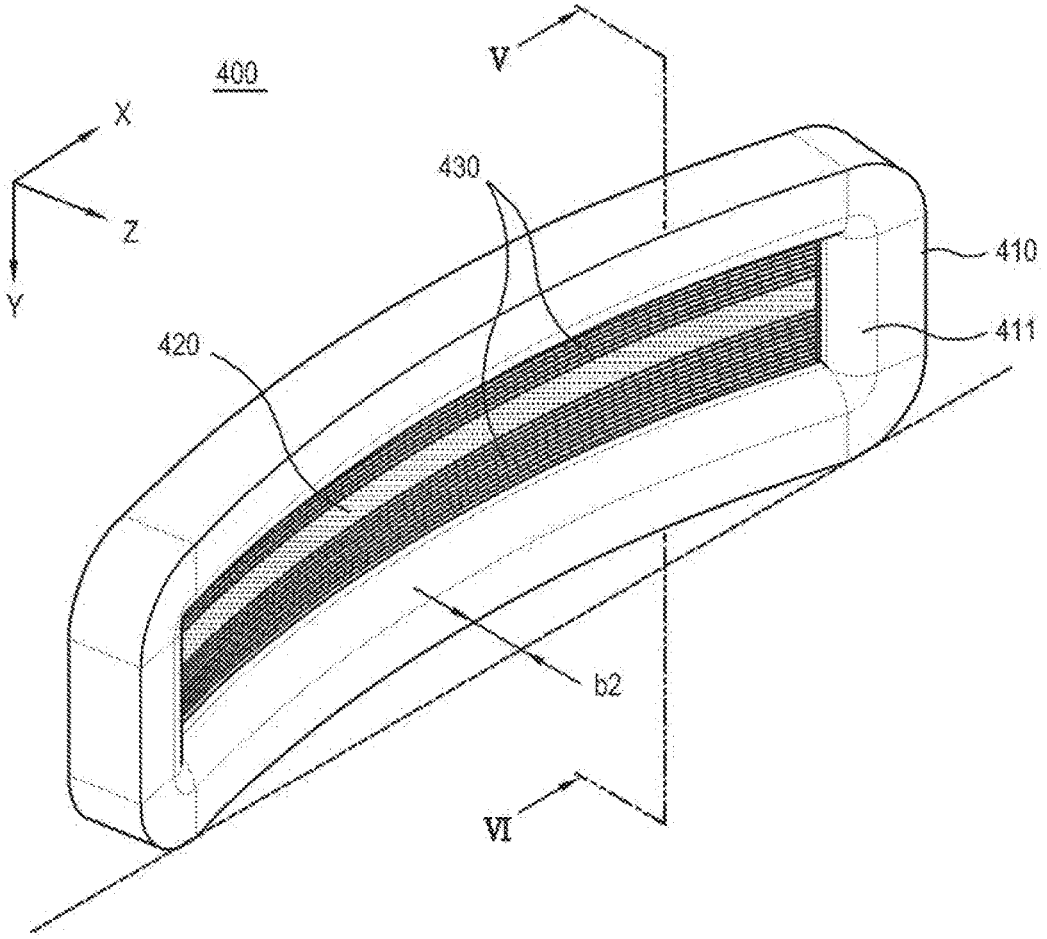
FIG. 14 is a perspective view of a loudspeaker device according to a fourth exemplary embodiment.

FIG. 14 is a perspective view of a loudspeaker device 400 according to a fourth exemplary embodiment. The loudspeaker device 400 according to the fourth exemplary embodiment is applicable to the audio output apparatus 100 by replacing the foregoing loudspeaker device according to the first exemplary embodiment.

As shown in FIG. 14, the loudspeaker device 400 according to the fourth exemplary embodiment includes a frame 410 bent to have a preset curvature and shaped like a rectangular plate extended in one direction, a diaphragm 420 arranged in a middle region of the frame 410, and a voice coil 430 embedded in the diaphragm 420. In terms of functions, the elements of the loudspeaker device 400 in this embodiment are similar to those of the foregoing exemplary embodiments, and thus repetitive descriptions will be avoided as necessary.

The loudspeaker device 400 according to the fourth exemplary embodiment is bent in a direction opposite to that of the third exemplary embodiment. On the contrary to the third exemplary embodiment, the loudspeaker device 400 according to the fourth exemplary embodiment worsens the 'off-axis' characteristic of the horizontal orientation. That is, a user cannot normally listen to a sound from the loudspeaker device 400 when they are in the 'off-axis' state, and can normally listen to a sound only when they are in the 'on-axis'. Therefore, the loudspeaker device 400 in this embodiment may be used under a special condition for preventing a user who is out of a certain position from hearing the output sound.

The frame 410 is lengthwise extended along the X direction. However, the frame 410 according to the fourth exemplary embodiment is bent inward in the middle toward a direction opposite to the direction of outputting a sound on the contrary to that of the third exemplary embodiment bent outward in the middle toward the direction of outputting the sound. That is, the center of the frame 410 is spaced apart at a distance of 'b2' from the top axial line of the X direction. The distance of 'b2' is determined by the bending curvature of the frame 410. If a user views the loudspeaker device 400 in front of the loudspeaker device 400, the frame 410 looks as if the center of the frame 410 is recessed inward.

The frame 410 has an opening 411 on the plane thereof toward the Z direction, so that the diaphragm 420 can be exposed through the opening 411 toward the Z direction. Further, a grille (not shown) may be additionally provided in the opening 411 and protect the diaphragm 420 from foreign materials without interfering with a sound output from the diaphragm 420.

The diaphragm 420 is not parallel to the X-Y plane, but bent to have a curvature corresponding to the bending curvature of the frame 410. While the diaphragm according to the third exemplary embodiment propagates a soundwave radially in many directions with respect to the axial line of the Z direction, the diaphragm 420 according to the fourth exemplary embodiment focuses a soundwave on a certain position without diffusing the soundwave.

The voice coil 430 is extended along the lengthwise direction of the diaphragm 420, and attached to the surface of the diaphragm 420 in the form of foil or printed on the diaphragm 420. That is, the voice coil 430 is also bent to have a curvature corresponding to the diaphragm 420 and the frame 410. When an audio signal is applied to the voice coil 430, the voice coil 430 and the diaphragm 420 embedded with the voice coil 430 are vibrated.

Thus, the loudspeaker device 400 according to this exemplary embodiment has a structure where the frame 410, the diaphragm 420 and the voice coil 430 are bent inward in the middle with respect to the direction opposite to the direction of outputting the sound. The frame 410, diaphragm 420 and voice coil 430 are provided to have substantially the same curvature.

Figure 15:
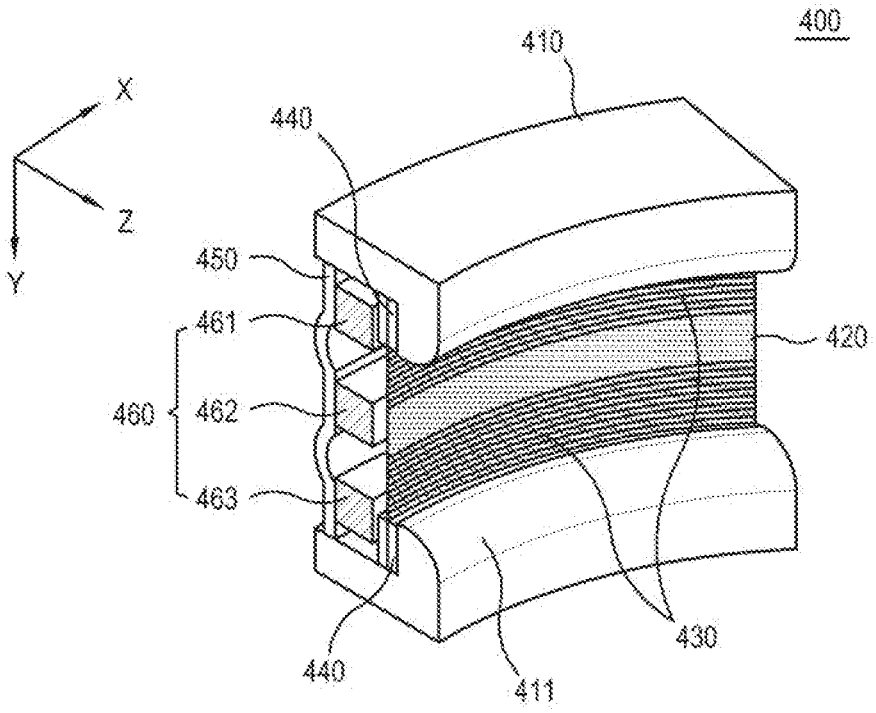
FIG. 15 is a cut-open perspective view of the loudspeaker device of FIG. 14, taken along the line V-VI.

FIG. 15 is a cut-open perspective view of the loudspeaker device of FIG. 14, taken along the line V-VI;

As shown in FIG. 15, the loudspeaker device 400 includes an edge 440, a steel plate 450, and magnets 460 provided on the steel plate 450 and extended at a predetermined distance from the diaphragm 420 and the voice coil 430.

The edge 440 is provided around the opening 411 along an upper surface edge of the frame 410, supporting the four edges of the diaphragm 420. the edge 440 is bent corresponding to the frame 410 so that the diaphragm 420 bent to have a certain curvature can be supported on the frame 410 bent to have substantially the same curvature. However, the edges parallel to the Y direction are not bent among the four edges of the diaphragm 420, and thus the corresponding edges 440 are not bent.

The magnet 460 is put on a top surface of the steel plate 450, which faces the diaphragm 420. The steel plate 450 is used as a passage through which the magnetic flux of the magnet 460 passes.

The magnet 460 is bent to have the same curvature as the diaphragm 420 and the voice coil 430 with respect to the axial line of the X direction along the extended direction of the diaphragm 420 and the voice coil 430. Therefore, a uniform gap is maintained between the top surface of the magnet 460 facing the diaphragm 420 and the diaphragm 420. This gap may be determined variously as long as the diaphragm 420 can vibrate and the voice coil 430 embedded in the diaphragm 420 is affected by the magnetic field of the magnet 460.

In this exemplary embodiment, there are three magnets 460 including a first magnet 461, a second magnet 462 and a fourth magnet 463, but not limited thereto. The number of magnets 460 does not limit the present inventive concept.

Like the foregoing exemplary embodiments, the upper poles of the adjacent magnets, which face toward the diaphragm 420, among the magnets 460 are opposite to each other, and the voice coil 430 is arranged to be interposed in between the magnets 460.

Briefly, the loudspeaker device 400 according to the fourth exemplary embodiment is bent inward in the middle in the direction of outputting a sound with respect to the axial line of the direction perpendicular to the direction of outputting the sound. In particular, the diaphragm 420, the voice coil 430 and the magnet 460 directly related to the sound output are bent to heave the same curvature, so that a sound cannot be heard by a user being in the 'off-axis' state as far as possible.

Additionally, the loudspeaker device according to the third exemplary embodiment is extended to have a preset length and bent outward in the middle in the direction of outputting a sound, thereby enlarging an audible region of a user positioned in front of the loudspeaker device. Such an audible region increases as the loudspeaker device becomes longer and the curvature becomes greater. In this regard, if the loudspeaker device is shaped to form a closed loop, the audible region can be expanded in all directions over 360 degrees. This embodiment will be described below.

Figure 16:
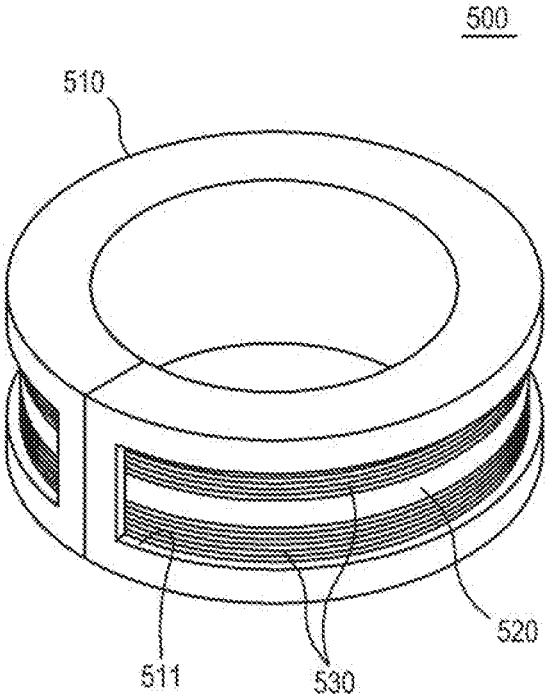
FIG. 16 is a perspective view of a loudspeaker device according to a fifth exemplary embodiment.

FIG. 16 is a perspective view of a loudspeaker device 500 according to a fifth exemplary embodiment;

As shown in FIG. 16, the loudspeaker device 500 includes a frame 510 having an opening 511, a diaphragm 520 provided in the opening 511, and a voice coil 530 embedded on the diaphragm 520. The loudspeaker device 500 has substantially the same basic structure as that of the third exemplary embodiment, and thus repetitive descriptions thereof will be avoided as necessary.

According to the fifth exemplary embodiment, the loudspeaker device 500 is formed to have a circular closed-loop by increasing the curvatures of the frame 510, the diaphragm 520, the voice coil 530 and the magnet (not shown) more than those of the third exemplary embodiment. Thus, the vibration of the diaphragm 520 causes a soundwave to travel over 360 degrees, thereby increasing a user's audible region in all directions.

Figure 17:
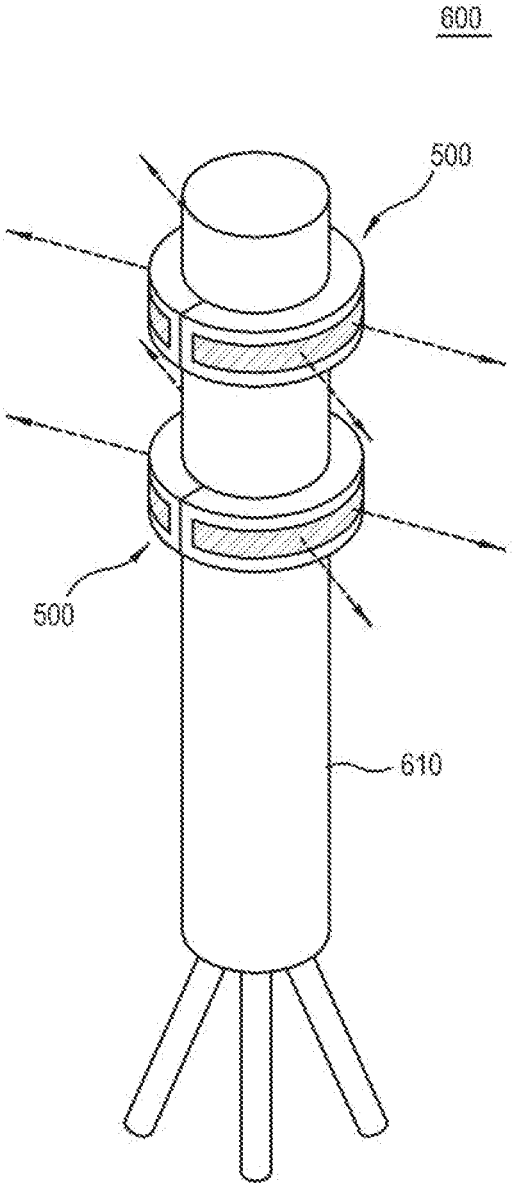
FIG. 17 is a perspective view of an audio output apparatus according to a sixth exemplary embodiment.

FIG. 17 is a perspective view of an audio output apparatus 600 according to a sixth exemplary embodiment;

As shown in FIG. 17, the audio output apparatus 600 according to the sixth exemplary embodiment includes a stand frame 610 having a cylindrical shape and standing on an installation surface, and one or more loudspeaker devices 500 provided on the outer circumference of the stand frame 610. The loudspeaker device 500 according to the sixth exemplary embodiment is the same as the loudspeaker device 500 according to the fifth exemplary embodiment.

The stand frame 610 is internally provided with most of elements for operating the audio output apparatus 600, and this structure was described with reference to FIG. 1 and FIG. 2. The outer diameter of the stand frame 610 is at least smaller than the inner diameter of the loudspeaker device 500, so that the loudspeaker device 500 can be installed on the outside of the stand frame 610. The stand frame 610 includes elements for supplying an electric signal to the loudspeaker device 500 and supporting the loudspeaker device 500.

If the audio output apparatus 600 supports audio signals corresponding to a plurality of channels, one or more loudspeaker devices 500 may be respectively provided corresponding to the channels. However, the structure of the loudspeaker device 500 according to this exemplary embodiment may be not suitable to cope with a channel of a low frequency band, and thus the audio output apparatus 600 may additionally include a loudspeaker device different from the loudspeaker device according to this exemplary embodiment in order to cope with the channel of the low frequency band.

With this structure, the audio output apparatus 600 can output a sound in all directions with respect to the radial direction of the stand frame 610.

In the foregoing third and fourth exemplary embodiments, the magnet and the voice coil are extended in parallel to the lengthwise direction of the loudspeaker device.

Figure 18:
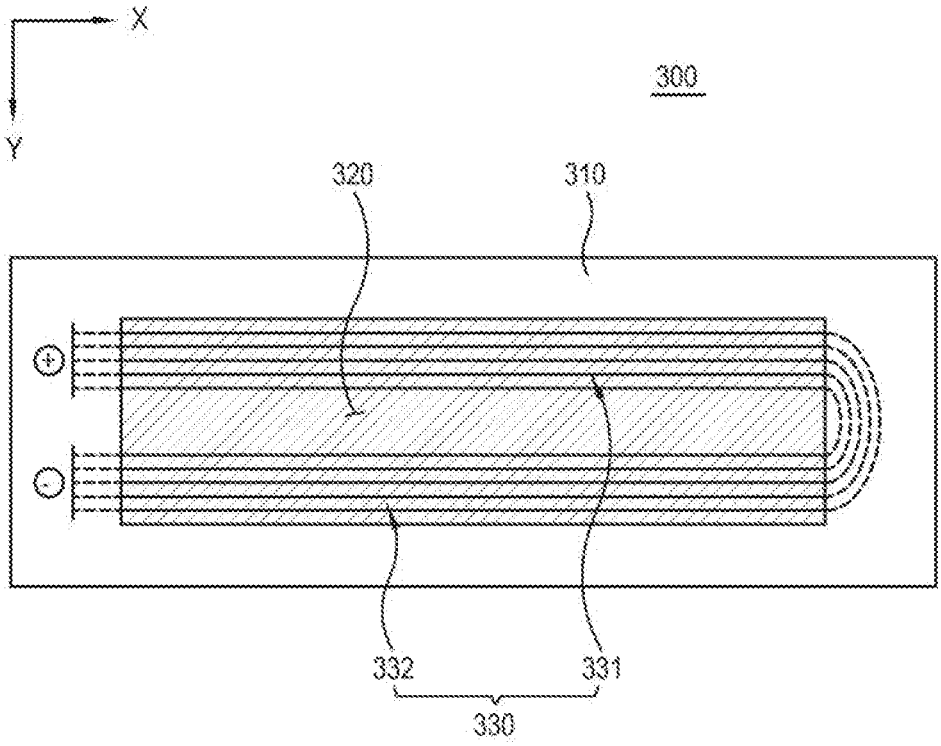
FIG. 18 is a view showing an example of a voice coil provided in the loudspeaker device according to the third exemplary embodiment.

FIG. 18 is a view showing an example of the voice coil 330 provided in the loudspeaker device 300 according to the fourth exemplary embodiment As shown in FIG. 18, the loudspeaker device 300 is extended along the X direction, and thus the voice coil 330 is also extended along the X direction. The voice coil 330 includes an upper track 331 given in an upper side of FIG. 18, and a lower track 332 given in a lower side of FIG. 18. The upper track 331 and the lower track 332 are connected at a right edge of the frame 310, and positive and negative electric signals corresponding to the audio signal are applied to a left edge of the frame.

If the loudspeaker device 300 receives an audio signal, a positive voltage of the electric signal corresponding to the audio signal is applied to the upper track 331 and a negative voltage of the electric signal corresponding to the audio signal is applied to the lower track 332, so that the voice coil 330 can form a loop circuit. Further, the voice coil 330 receiving the voltage is driven by the magnetic field of the magnet (not shown), thereby vibrating the diaphragm 320.

With this structure, one loudspeaker device 300 is difficult to have an elevation effect since the voice coil 330 forms only one loop circuit. For example, the elevation effect is to make a user recognize as if a sound corresponding to a vehicle moves from left to right while an image where the vehicle moves from left to right is displayed.

Below, an embodiment where the loudspeaker device with a structure for having such an elevation effect will be described.

Figure 19:
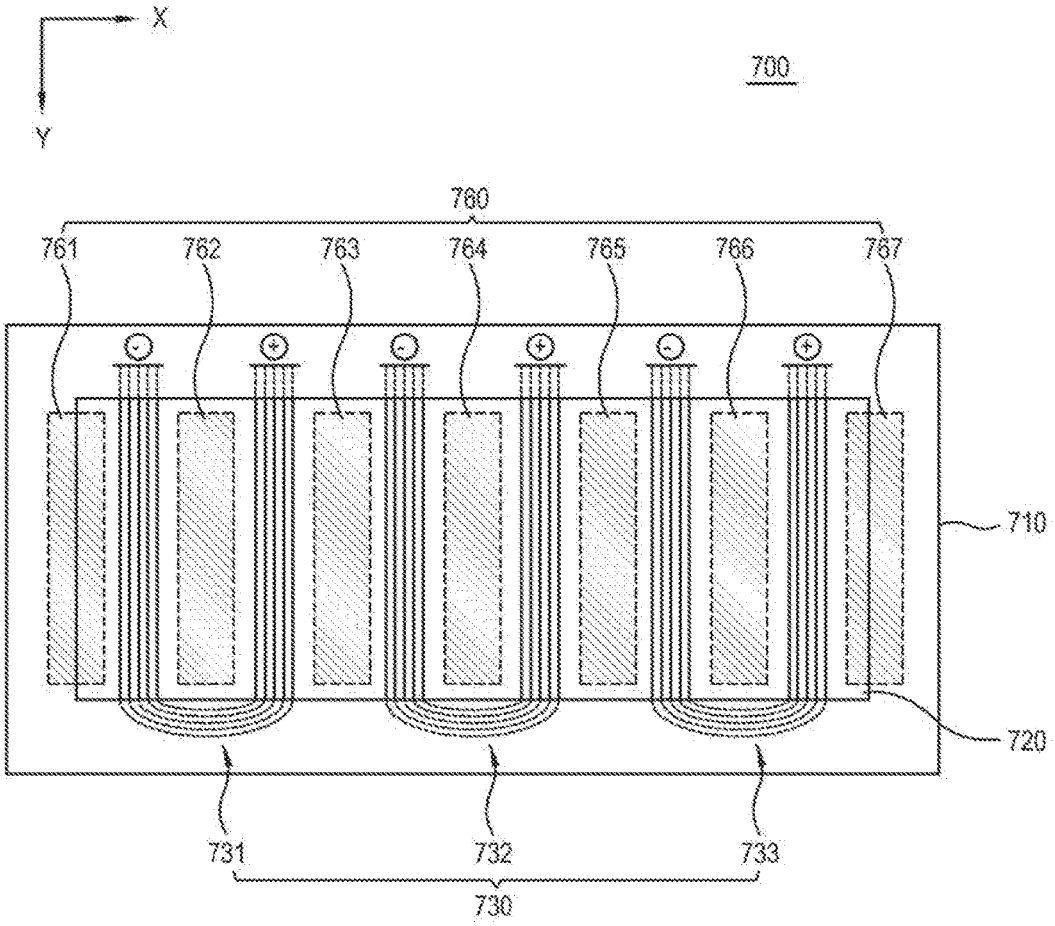
FIG. 19 is a view showing an example of voice coils and magnets provided in a loudspeaker device according to a seventh exemplary embodiment.

FIG. 19 is a view showing an example of voice coils 730 and magnets 760 provided in a loudspeaker device 700 according to a seventh exemplary embodiment.

As shown in FIG. 19, the loudspeaker device 700 according to the seventh exemplary embodiment includes a frame 710 lengthwise extended along the X direction, a diaphragm 720, voice coils 730 embedded on the diaphragm 720, and magnets 760 for forming magnetic fields behind the voice coils 730. In this embodiment, the loudspeaker device 700 is bent outward in the middle along the lengthwise direction frontward in the direction of outputting a sound, and the frame 710 and the diaphragm 720 are also bent corresponding to the loudspeaker device 700. However, the voice coil 730 and the magnet 760 are substantially straightly extended along the Y direction.

The voice coils 730 include a first track 731, a second track 732 and a third track 733, which are arranged in sequence along the X direction. The first track 731, the second track 732 and the third track 733 are extended along the Y direction, and receive electric signals, respectively. That is, the voice coils 730 according to this exemplary embodiment include a plurality of loop circuits.

The magnets 760 include a first magnet 761, a second magnet 762, a third magnet 763, a fourth magnet 764, a fifth magnet 765, a sixth magnet 766 and a seventh magnet 767, which are arranged in between the respective voice coils 730. These magnets 760 are arranged in between the first track 731 and the second track 732 and the third track 733, thereby forming the magnetic fields.

Since the voice coils 730 include the plurality of loop circuits to which the electric signals are respectively applied, it is possible to respectively apply electric signals corresponding to different audio signals to the first track 731, the second track 732 and the third track 733, or apply electric signals to some of the first track 731, the second track 732 and the third track 733.

With this structure, the loudspeaker device 700 may output a sound as if the sound moves from left and right while an image where a vehicle moves from left to right is displayed. In this case, the loudspeaker device 700 outputs the sound as if a sound source moves in the X direction.

That is, the loudspeaker device 700 does not simultaneously drive the first track 731, the second track 732 and the third track 733, but drives them at different times. For example, the loudspeaker device 700 first drives only the first track 731 among the first track 731, the second track 732 and the third track 733, then drives only the second track 732, and lastly drives only the third track 733. Accordingly, a vibrating position is biased on the diaphragm 720, and therefore a user recognizes the sound output from the loudspeaker device 700 as if a sound source moves from left to right.

With this structure, the sound of the loudspeaker device 700 can have the elevation effect.

In the foregoing exemplary embodiments, the loudspeaker device is mounted to the audio output apparatus for outputting a sound. However, the audio output apparatus may support various functions in addition to the functions of outputting or processing a sound. As an example of this audio output apparatus, there is a video processing apparatus or a display apparatus.

Figure 20:
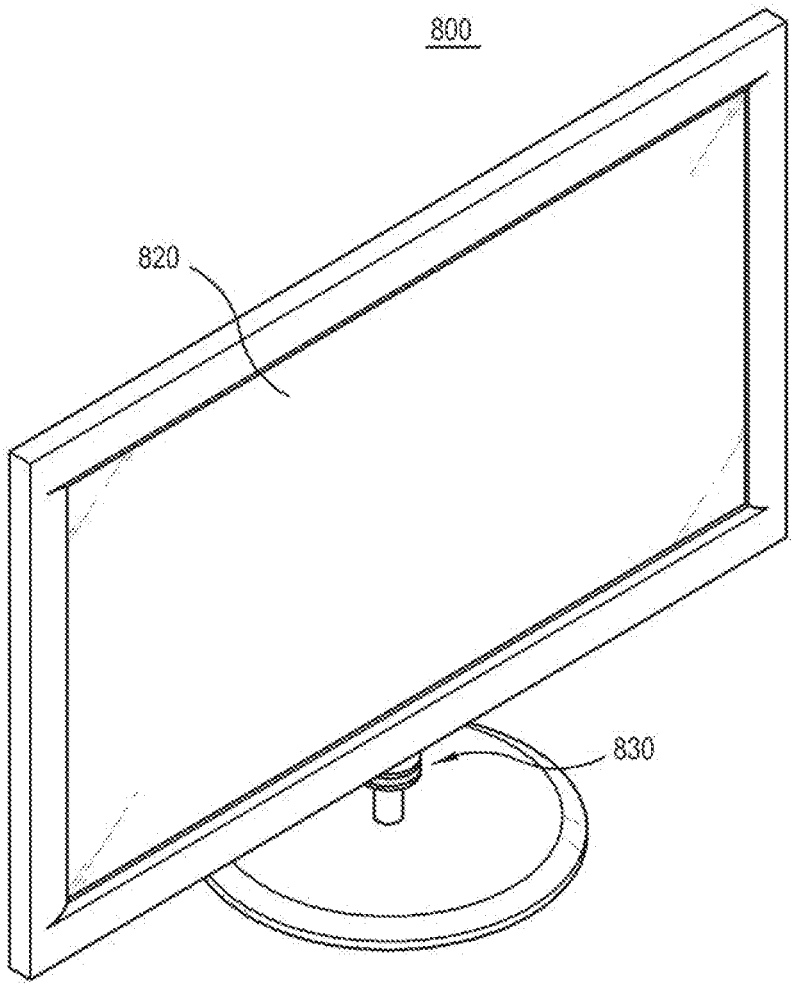
FIG. 20 is a view showing an example of a video processing apparatus according to an eighth exemplary embodiment.

FIG. 20 is a view showing an example of a video processing apparatus 800 according to an eighth exemplary embodiment.

As shown in FIG. 20, the video processing apparatus 800 according to the eighth exemplary embodiment is achieved by a television (TV), but not limited thereto. Alternatively, the video processing apparatus may be achieved by a tablet personal computer (PC), a mobile phone, a multimedia player, an electronic frame, a digital signage and the like apparatus of displaying an image, or by a set-top box and the like apparatus of processing an image without displaying it by itself. In addition, the present inventive concept may be applied to a general electronic apparatus for performing an audio process regardless of a video process.

The video processing apparatus 800 processes a transport stream of video contents received from the exterior and displays it as an image. The transport stream of the video contents may be a radio frequency (RF) broadcast signal received from a transmitter (not shown) of a broadcasting station, a data packet received from a server (not shown) through a network, or a signal reproduced and transmitted from a multimedia player (not shown) locally connected to the video processing apparatus 800. In addition, the transport stream of the video contents may be generated based on data stored in the video processing apparatus 800.

Generally, the video contents may further include audio data or additional data as well as video data. For example, the video processing apparatus 800 extracts a video signal component and an audio signal component from the transport stream, and processes and outputs the respective components. To this end, the video processing apparatus 800 includes a display 820 for displaying an image, and a loudspeaker device 830 for producing a sound. At this time, the video processing apparatus 800 synchronizes display of an image with production of a sound, thereby normally providing the video contents to a user.

There is no limit to the shape and position of mounting the loudspeaker device 830 to the video processing apparatus 800. For example, the loudspeaker device 830 may be mounted to a lower center of the display 820, so that a sound output from the loudspeaker device 830 can be propagated leftward and rightward, keeping a balance.

Below, the video processing apparatus 800 will be described in more detail.

Figure 21:
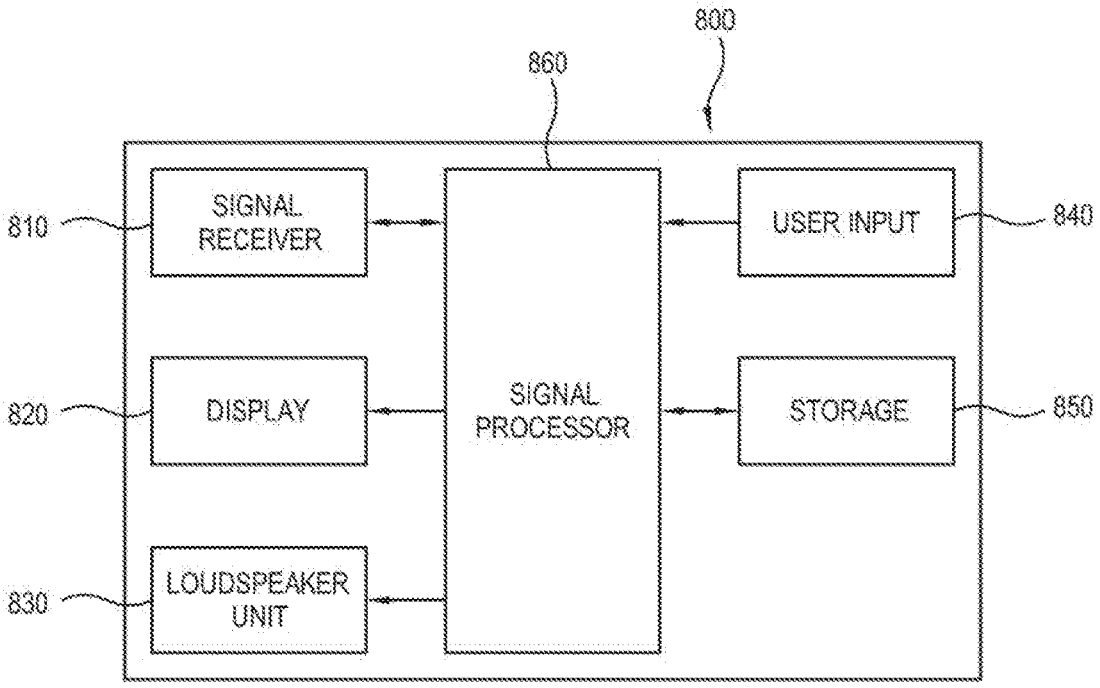
FIG. 21 is a block diagram of the video processing apparatus of FIG. 20.

FIG. 21 is a block diagram of the video processing apparatus 800.

As shown in FIG. 21, the video processing apparatus 800 includes a signal receiver 810 for receiving the transport stream of the video contents from the exterior, the display 820 for displaying an image based on video data of the transport stream received in the signal receiver 810, the loudspeaker device 830 for producing a sound based on audio data of the transport stream received in the signal receiver 810, the user input 840 for receiving a user's input, a storage 850 for storing data, and a signal processor 860 for controlling and calculating general operations of the video processing apparatus 800

The signal receiver 810 receives transport streams from various video sources. The signal receiver 810 is not limited to only receiving a signal from the exterior, but may transmit a signal to the exterior, thereby performing interactive communication. The signal receiver 810 may be achieved by an assembly of communication ports or communication modules respectively corresponding to a plurality of communication standards, and its supportable protocols and communication targets are not limited to one kind or type. For example, the signal receiver 810 may include a radio frequency integrated circuit (RFIC) for receiving an RF signal, a wi-fi communication module (not shown) for wireless network communication, an Ethernet module (not shown) for wired network communication, and a universal serial bus (USB) port (not shown) for local connection with a USB memory (not shown) or the like.

The display 820 displays an image based on an image signal processed by the signal processor 860. There are no limits to the types of the display 820. For example, the display 820 may be achieved by various display types such as liquid crystal, plasma, a light-emitting diode, an organic light-emitting diode, a surface-conduction electron emitter, a carbon nano-tube, nano-crystal, etc.

The display 820 may include additional elements in accordance with the types of the panel in addition to the panel structure for displaying an image. For example, if the display 820 is achieved by the liquid crystal, the display 820 includes a liquid crystal display (LCD) panel (not shown), a backlight unit (not shown) for supplying light to the LCD panel, and a panel driving substrate (not shown) for driving the LCD panel (not shown).

The loudspeaker device 830 outputs a sound based on the audio signal processed by the signal processor 860. The loudspeaker device 830 in this exemplary embodiment can have the same structures as those described above in the foregoing exemplary embodiment, and thus repetitive descriptions thereof will be avoided as necessary.

The user input 840 transmits various preset control commands or information to the signal processor 860 in accordance with a user's control or input. The user input 840 transmits various events, which occurs by a user's control in accordance with a user's intention, to the signal processor 860. The input unit 840 may be variously achieved in accordance with information input methods. For example, the input unit 840 may include a button provided on an outer side of the video processing apparatus 800, a separate remote controller separated from the video processing apparatus 800, a touch screen formed integrally with the display 820, and an input device provided to communicate with the video processing apparatus 800.

The storage 850 stores various pieces of data under process and control of the signal processor 860. The storage 850 is accessed by the signal processor 860 and performs reading, writing, editing, deleting, updating or the like with regard to data. The storage 850 is achieved by a flash-memory, a hard-disc drive or the like nonvolatile memory to preserve data regardless of supply of system power in the video processing apparatus 800.

The signal processor 860 performs various processes with regard to the transport stream received in the signal receiver 810. When the transport stream is received in the signal receiver 810, the signal processor 860 applies a video processing process to the video signal, and outputs the processed video signal to the display 820, thereby displaying an image on the display 820.

There are no limits to the kind of image processing process performed by the signal processor 860, and the video processing process may for example include demultiplexing for separating the transport stream into sub streams such as a video signal, an audio signal and additional data, decoding corresponding to video formats of a video signal, de-interlacing for converting a video signal from an interlaced type into a progressive type, scaling for adjusting a video signal to have a preset resolution, noise reduction for improving image quality, detail enhancement, frame refresh rate conversion, etc.

Since the signal processor 860 can perform various processes in accordance with the kinds and characteristics of signal or data, the process performable by the signal processor 860 is not limited to the video processing process. Further, data processable by the signal processor 860 is not limited to only data received in the signal receiver 810. For example, the signal processor 860 performs an audio processing process with regard to an audio signal extracted from a transport stream, and outputs the processed audio signal to the loudspeaker device 830. Further, if a user's voice is input to the video processing apparatus 800, the signal processor 860 may process the voice in accordance with a preset voice recognition processing process. The signal processor 860 is achieved by a system-on-chip (SOC), in which many functions are integrated, or an image processing board (not shown) where individual chip-sets for independently performing the processes are mounted to a printed circuit board.

The video processing apparatus 800 may have specifically different hardware components in accordance with the types of the video processing apparatus 800 and the functions supported by the video processing apparatus 800. For example, a hardware component to be tuned to a certain frequency for receiving a broadcast signal may be included if the video processing apparatus 800 is a TV or a set-top box, but may be excluded if the video processing apparatus 800 is a tablet PC.

Below, the signal processor 860 of when the video processing apparatus 800 is the TV will be described.

Figure 22:
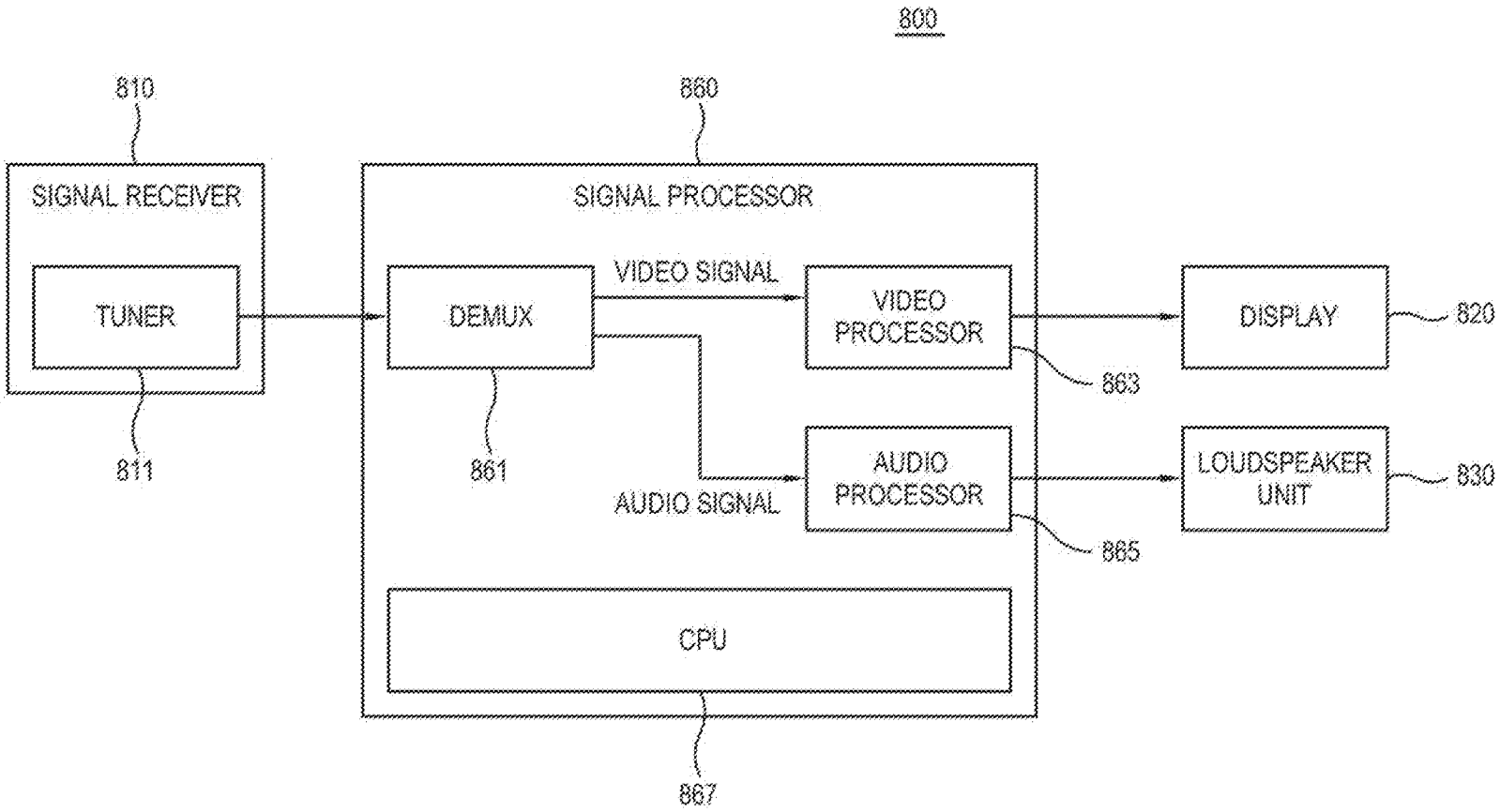
FIG. 22 is a block diagram of a signal processor in the video processing apparatus of FIG. 20.

FIG. 22 is a block diagram of the signal processor 860. FIG. 22 shows only basic elements of the signal processor 860, and an actual product of the video processing apparatus 800 includes additional elements besides the elements described below.

As shown in FIG. 22, the signal receiver 810 includes a tuner 811 to be tuned to a certain frequency to receive a broadcast stream. Further, the signal processor 860 includes a deMUX 861 for dividing the broadcast stream received from the tuner 811 into a plurality of sub signals, a video processor 863 for processing a video signal among the sub signals output from the deMUX 861 in accordance with the video processing process and outputting the processed video signal to the display 820, an audio processor 865 for processing an audio signal among the sub signals output from the deMUX 861 in accordance with the audio processing process and outputting the processed audio signal to the loudspeaker device 830, and a central processing unit (CPU) 867 performs calculation and control for the operations of the signal processor 860.

When a broadcast stream is received in an RF antenna (not shown), the tuner 811 is tuned to a frequency of a designated channel to receive a broadcast stream and converts the broadcast stream into a transport stream. The tuner 811 converts a high frequency of a carrier wave received via the antenna (not shown) into an intermediate frequency band and converts it into a digital signal, thereby generating a transport stream. To this end, the tuner 811 has an analog/digital (A/D) converter (not shown). Alternatively, the A/D converter (not shown) may be designed to be included in a demodulator (not shown) instead of the tuner 811.

The deMUX (or demultiplexer) 861 performs a reverse operation of the multiplexer (not shown). That is, the deMUX 861 connects one input terminal with a plurality of output terminals, and distributes a stream input to the input terminal to the respective output terminals in accordance with selection signals. For example, if there are four output terminals with respect to one input terminal, the deMUX 861 may select each of the four output terminals by combination of selection signals having two levels of 0 and 1.

In the case where the deMUX 861 is applied to the video processing apparatus 800, the deMUX 861 divides the transport stream received from the tuner 811 into the sub signals of a video signal and an audio signal and outputs them to the respective output terminals.

The deMUX 861 may use various methods to divide the transport stream into the sub signals. For example, the deMUX 861 divides the transport stream into the sub signals in accordance with packet identifiers (PID) given to packets in the transport stream. The sub signals in the transport stream are independently compressed and packetized according to channels, and the same PID is given to the packets corresponding to one channel so as to be distinguished from the packets corresponding to another channel. The deMUX 861 classifies the packets in the transport stream according to the PID, and extracts the sub signals having the same PID.

The video processor 863 decodes and scales the video signal output from the deMUX 861. To this end, the video processor 863 includes a decoder (not shown) that returns the video signal to a state before an encoding process by performing an opposite process to the encoding process with regard to the video signal encoded by a certain format, and a scaler (not shown) that scales the decoded video signal in accordance with the resolution of the display 820 or a separately designated resolution. If the video signal output from the deMUX 861 is not encoded by a certain format, i.e. not compressed, the decoder (not shown) of the video processor 863 does not process this video signal.

The audio processor 865 amplifies an audio signal output from the deMUX 861. The audio processor 865 is the same as those of the foregoing exemplary embodiments, and thus repetitive descriptions thereof will be avoided.

The CPU 867 is an element for performing central calculation to operate general elements in the signal processor 860, and plays a central role in basically parsing and calculating data. The CPU 867 internally includes a processor register (not shown) in which commands to be processed are stored; an arithmetic logic unit (ALU) (not shown) being in charge of comparison, determination and calculation; a control unit (not shown) for internally controlling the CPU 867 to analyze and carry out the commands; an internal bus (not shown), a cache (not shown), etc.

The CPU 867 performs calculation needed for operating the elements of the signal processor 860, such as the deMUX 861, the video processor 863 and the audio processor 165. Alternatively, some elements of the signal processor 860 may be designed to operate without the data calculation of the CPU 867 or by a separate microcontroller (not shown).

The methods according to the foregoing exemplary embodiments may be achieved in the form of a program command that can be implemented in various computers, and recorded in a computer readable medium. Such a computer readable medium may include a program command, a data file, a data structure or the like, or combination thereof. For example, the computer readable medium may be stored in a voltage or nonvolatile storage such as a read only memory (ROM) or the like, regardless of whether it is deletable or rewritable, for example, a RAM, a memory chip, a device or integrated circuit (IC) like memory, or an optically or magnetically recordable or machine (e.g., a computer)-readable storage medium, for example, a compact disk (CD), a digital versatile disk (DVD), a magnetic disk, a magnetic tape or the like. It will be appreciated that a memory, which can be included in a mobile terminal, is an example of the machine-readable storage medium suitable for storing a program having instructions for materializing the exemplary embodiments. The program command recorded in this storage medium may be specially designed and configured according to the exemplary embodiments, or may be publicly known and available to those skilled in the art of computer software.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A loudspeaker device comprising:

a frame comprising a bottom portion having a curved surface along a first direction and a pair of lateral portions provided at lateral sides of the bottom portion;

a plurality of magnets curved along the curved surface of the bottom portion, the plurality of magnets arranged to be spaced apart from each other;

a diaphragm supported by the pair of lateral portions, the diaphragm being curved along the curved surface of the bottom portion, and spaced apart from top surfaces of the plurality of magnets; and a coil provided on the diaphragm at positions corresponding to spaces between the plurality of magnets, and the coil being configured to drive the diaphragm to vibrate in a direction perpendicular to the surface of the diaphragm by a magnetic field formed by the plurality of magnets as an audio signal is electrically applied, wherein the bottom portion is bent outward in the middle toward the direction of outputting a sound and the diaphragm, the coil and the plurality of magnets are bent such that curvatures thereof correspond to one another.

2. The loudspeaker device according to claim 1, wherein the curved surface has different curvatures between at least two sections along the first direction.

3. The loudspeaker device according to claim 1, wherein the plurality of magnets are arranged to make their upper sides alternate in polarities along the first direction, and the coils are arranged in between the plurality of magnets.

4. The loudspeaker device according to claim 1, wherein the coil and the diaphragm are provided on an outer circumferential side of the magnet having a circular closed-loop, and the diaphragm is configured to vibrate in a radial direction of the magnet to make a sound.

5. The loudspeaker device according to claim 1, wherein the bottom portion comprises conductive metal, and is configured to support lower surfaces of the plurality of magnets.

6. An audio output apparatus comprising:

one or more loudspeaker devices; and an audio processor configured to process an audio signal to make a sound from the loudspeaker device, at least one of the one or more loudspeaker devices comprising a frame comprising a bottom portion having a curved surface along a first direction and a pair of lateral portions provided at lateral sides of the bottom portion;

a plurality of magnets curved along the curved surface of the bottom portion and arranged to be spaced apart from each other;

a diaphragm supported by the pair of lateral portions, the diaphragm being curved along the curved surface of the bottom portion, and spaced apart from top surfaces of the plurality of magnets; and a coil provided on the diaphragm at positions corresponding to spaces between the plurality of magnets, the coil being configured to drive the diaphragm to vibrate in a direction perpendicular to the surface of the diaphragm by a magnetic field formed by the plurality of magnets as the audio signal processed by the audio processor is electrically applied, wherein the bottom portion is bent outward in the middle toward the direction of outputting a sound and the diaphragm, the coil and the plurality of magnets are bent such that curvatures thereof correspond to one another.

7. The audio output apparatus according to claim 6, wherein the curved surface has different curvatures between at least two sections along the first direction.

8. The audio output apparatus according to claim 6, wherein the plurality of magnets are arranged to make their upper sides alternate in polarities along the first direction, and the coils are arranged in between the plurality of magnets.

9. The audio output apparatus according to claim 6, wherein the coil and the diaphragm are provided on an outer circumferential side of the magnet having a circular closed-loop, and the diaphragm is configured to vibrate in a radial direction of the magnet to make a sound.

10. The audio output apparatus according to claim 6, wherein the bottom portion comprises conductive metal, and supports lower surfaces of the plurality of magnets.

* * * * *